US008616919B2

(12) United States Patent
Stoner

(10) Patent No.: US 8,616,919 B2
(45) Date of Patent: Dec. 31, 2013

(54) ATTACHMENT SYSTEM FOR ELECTRICAL CONNECTOR

(75) Inventor: Stuart C. Stoner, Lewisberry, PA (US)

(73) Assignee: FCI Americas Technology LLC, Carson City, NV (US)

( * ) Notice: Subject to any disclaimer, the term of this patent is extended or adjusted under 35 U.S.C. 154(b) by 162 days.

(21) Appl. No.: 12/938,792

(22) Filed: Nov. 3, 2010

(65) Prior Publication Data

US 2011/0117781 A1 May 19, 2011

Related U.S. Application Data

(60) Provisional application No. 61/261,097, filed on Nov. 13, 2009.

(51) Int. Cl.
*H01R 13/648* (2006.01)

(52) U.S. Cl.
USPC ..... 439/607.07

(58) Field of Classification Search
USPC ..... 439/607.01, 607.05–607.09
See application file for complete search history.

(56) References Cited

U.S. PATENT DOCUMENTS

| | | | |
|---|---|---|---|
| 2,664,552 | A | 12/1953 | Ericsson et al. |
| 2,849,700 | A | 8/1958 | Perkin |
| 2,858,372 | A | 10/1958 | Kaufman |
| 3,115,379 | A | 12/1963 | McKee |
| 3,286,220 | A | 11/1966 | Marley et al. |
| 3,343,120 | A | 9/1967 | Whiting |
| 3,399,372 | A | 8/1968 | Uberbacher |
| 3,482,201 | A | 12/1969 | Schneck |
| 3,538,486 | A | 11/1970 | Shlesinger, Jr. |
| 3,587,028 | A | 6/1971 | Uberbacher |
| 3,591,834 | A | 7/1971 | Kolias |
| 3,641,475 | A | 2/1972 | Irish et al. |
| 3,663,925 | A | 5/1972 | Proctor |
| 3,669,054 | A | 6/1972 | Desso et al. |
| 3,701,076 | A | 10/1972 | Irish |
| 3,748,633 | A | 7/1973 | Lundergan |
| 3,827,005 | A | 7/1974 | Friend |
| 3,867,008 | A | 2/1975 | Gartland, Jr. |

(Continued)

FOREIGN PATENT DOCUMENTS

| | | |
|---|---|---|
| EP | 0 273 683 | 7/1988 |
| EP | 0 635 910 | 1/1995 |

(Continued)

OTHER PUBLICATIONS

U.S. Appl. No. 60/584,928, filed Jul. 1, 2004, Cohen.

(Continued)

*Primary Examiner* — Neil Abrams
*Assistant Examiner* — Travis Chambers
(74) *Attorney, Agent, or Firm* — Woodcock Washburn LLP

(57) ABSTRACT

An electrical connector includes at least one leadframe assembly, including a leadframe housing that carries a plurality of electrical contacts, and an external component, such as an electrically conductive plate, configured to be attached to the leadframe housing. The leadframe assembly includes an attachment system that includes an alignment assembly configured to align the electrically conductive plate with the leadframe housing as the plate is attached to the housing, and an attachment assembly that can be mated to attach the plate to the leadframe housing. The attachment assembly can be provided without creating any openings in the plate.

24 Claims, 16 Drawing Sheets

(56) References Cited

U.S. PATENT DOCUMENTS 4,030,792 A 6/1977 Fuerst
4,076,362 A 2/1978 Ichimura
4,084,872 A 4/1978 Pritulsky
4,157,612 A 6/1979 Rainal
4,159,861 A 7/1979 Anhalt
4,232,924 A 11/1980 Kline et al.
4,260,212 A 4/1981 Ritchie et al.
4,288,139 A 9/1981 Cobaugh et al.
4,383,724 A 5/1983 Verhoeven
4,402,563 A 9/1983 Sinclair
4,407,552 A 10/1983 Watanabe et al.
4,482,937 A 11/1984 Berg
4,487,464 A 12/1984 Kirschenbaum
4,523,296 A 6/1985 Healy, Jr.
4,560,222 A 12/1985 Dambach
4,571,014 A 2/1986 Robin et al.
4,607,899 A 8/1986 Romine et al.
4,664,456 A 5/1987 Blair et al.
4,664,458 A 5/1987 Worth
4,681,549 A 7/1987 Peterson
4,717,360 A 1/1988 Czaja
4,762,500 A 8/1988 Dola et al.
4,776,803 A 10/1988 Pretchel et al.
4,815,987 A 3/1989 Kawano et al.
4,846,727 A 7/1989 Glover et al.
4,850,887 A 7/1989 Sugawara
4,867,713 A 9/1989 Ozu et al.
4,898,539 A 2/1990 Glover et al.
4,900,271 A 2/1990 Colleran et al.
4,907,990 A 3/1990 Bertho et al.
4,913,664 A 4/1990 Dixon et al.
4,917,616 A 4/1990 Demler, Jr. et al.
4,932,888 A 6/1990 Senor
4,954,093 A 9/1990 Nadin
4,973,271 A 11/1990 Ishizuka et al.
4,975,066 A 12/1990 Sucheski et al.
4,975,069 A 12/1990 Fedder et al.
4,997,390 A 3/1991 Scholz et al.
5,004,426 A 4/1991 Barnett
5,046,960 A 9/1991 Fedder
5,055,054 A 10/1991 Doutrich
5,065,282 A 11/1991 Polonio
5,066,236 A 11/1991 Broeksteeg
5,077,893 A 1/1992 Mosquera et al.
5,094,623 A 3/1992 Scharf et al.
5,098,311 A 3/1992 Roath et al.
5,104,341 A * 4/1992 Gilissen et al. ..... 439/607.4
5,127,839 A 7/1992 Korsunsky et al.
5,141,455 A 8/1992 Ponn
5,161,987 A 11/1992 Sinisi
5,163,337 A 11/1992 Herron et al.
5,163,849 A 11/1992 Fogg et al.
5,167,528 A 12/1992 Nishiyama et al.
5,169,337 A 12/1992 Ortega et al.
5,174,770 A 12/1992 Sasaki et al.
5,181,855 A 1/1993 Mosquera et al.
5,197,893 A 3/1993 Morlion et al.
5,226,826 A 7/1993 Nillson et al.
5,228,864 A 7/1993 Fusselman et al.
5,231,274 A 7/1993 Reynier et al.
5,238,414 A 8/1993 Yaegashi et al.
5,254,012 A 10/1993 Wang
5,257,941 A 11/1993 Lwee et al.
5,274,918 A 1/1994 Reed
5,277,624 A 1/1994 Champion et al.
5,286,212 A * 2/1994 Broeksteeg ..... 439/108
5,288,949 A 2/1994 Crafts
5,302,135 A 4/1994 Lee
5,330,371 A 7/1994 Andrews
5,342,211 A 8/1994 Broeksteeg
5,356,300 A 10/1994 Costello et al.
5,356,301 A 10/1994 Champion et al.
5,357,050 A 10/1994 Baran et al.
5,382,168 A 1/1995 Azuma et al.
5,387,111 A 2/1995 DeSantis et al.
5,395,250 A 3/1995 Englert, Jr. et al.
5,399,104 A 3/1995 Middlehurst et al.
5,429,520 A 7/1995 Morlion et al.
5,431,578 A 7/1995 Wayne
5,474,472 A 12/1995 Niwa et al.
5,475,922 A 12/1995 Tamura et al.
5,518,422 A 5/1996 Zell et al.
5,522,727 A 6/1996 Saito et al.
5,522,738 A 6/1996 Lace
5,558,542 A 9/1996 O'Sullivan et al.
5,564,949 A 10/1996 Wellinsky
5,575,688 A 11/1996 Crane, Jr.
5,586,908 A 12/1996 Lorrain
5,586,912 A 12/1996 Eslampour et al.
5,586,914 A 12/1996 Foster, Jr. et al.
5,590,463 A 1/1997 Feldman et al.
5,609,502 A 3/1997 Thumma
5,620,340 A 4/1997 Andrews
5,626,492 A 5/1997 Onizuka et al.
5,634,821 A 6/1997 Crane, Jr.
5,637,019 A 6/1997 Crane, Jr. et al.
5,664,968 A * 9/1997 Mickievicz ..... 439/607.1
5,668,408 A 9/1997 Nicholson
5,672,064 A 9/1997 Provencher et al.
5,697,799 A 12/1997 Consoli et al.
5,713,746 A 2/1998 Olson et al.
5,713,767 A 2/1998 Hanson et al.
5,716,237 A 2/1998 Conorich
5,730,609 A 3/1998 Harwath
5,741,144 A 4/1998 Elco et al.
5,741,161 A 4/1998 Cahaly et al.
5,766,023 A 6/1998 Noschese et al.
5,775,947 A 7/1998 Suzuki et al.
5,782,656 A 7/1998 Zell et al.
5,795,191 A 8/1998 Preputnick et al.
5,803,768 A 9/1998 Zell et al.
5,817,973 A 10/1998 Elco et al.
5,820,392 A 10/1998 Lin et al.
5,823,828 A 10/1998 Bricaud et al.
5,833,475 A 11/1998 Mitra
5,853,797 A 12/1998 Fuchs et al.
5,860,816 A 1/1999 Provencher et al.
5,871,362 A 2/1999 Campbell et al.
5,876,222 A 3/1999 Gardner et al.
5,882,227 A 3/1999 Neidich
5,887,158 A 3/1999 Sample et al.
5,892,791 A 4/1999 Moon
5,893,761 A 4/1999 Loungeville
5,902,136 A 5/1999 Lemke et al.
5,904,581 A 5/1999 Pope et al.
5,908,333 A 6/1999 Perino et al.
5,921,810 A 7/1999 Murakoshi
5,921,818 A 7/1999 Larsen et al.
5,938,479 A 8/1999 Paulson et al.
5,961,355 A 10/1999 Morlion et al.
5,967,844 A 10/1999 Doutrich et al.
5,971,817 A 10/1999 Longueville
5,980,321 A 11/1999 Cohen et al.
5,984,690 A 11/1999 Riechelmann et al.
5,992,953 A 11/1999 Rabinovitz
5,993,259 A 11/1999 Stokoe et al.
6,007,376 A 12/1999 Shimizu
6,022,227 A 2/2000 Huang
6,027,345 A 2/2000 McHugh et al.
6,042,427 A 3/2000 Adriaenssens et al.
6,050,862 A 4/2000 Ishii
6,053,751 A 4/2000 Humphrey
6,068,520 A 5/2000 Winings et al.
6,086,386 A 7/2000 Fjrlstad et al.
6,116,926 A 9/2000 Ortega et al.
6,116,965 A 9/2000 Arnett et al.
6,123,554 A 9/2000 Ortega et al.
6,125,535 A 10/2000 Chiou et al.
6,129,592 A 10/2000 Mickievicz et al.
6,132,255 A 10/2000 Verhoeven
6,139,336 A 10/2000 Olson
6,146,157 A 11/2000 Lenoir et al.
6,146,203 A 11/2000 Elco et al.
6,152,747 A 11/2000 McNamara

(56) References Cited

U.S. PATENT DOCUMENTS 6,154,742 A 11/2000 Herriot
6,171,115 B1 1/2001 Mickievicz et al.
6,171,149 B1 1/2001 Van Zanten
6,179,663 B1 1/2001 Bradley et al.
6,190,213 B1 2/2001 Reichart et al.
6,210,227 B1 4/2001 Yamasaki et al.
6,212,755 B1 4/2001 Shimada et al.
6,219,913 B1 4/2001 Uchiyama
6,220,896 B1 4/2001 Bertoncini et al.
6,224,432 B1 5/2001 Billma
6,227,882 B1 5/2001 Ortega et al.
6,241,535 B1 6/2001 Lemke et al.
6,267,604 B1 7/2001 Mickievicz et al.
6,269,539 B1 8/2001 Takahashi et al.
6,273,759 B1 8/2001 Perino et al.
6,280,209 B1 8/2001 Bassler et al.
6,280,809 B1 8/2001 Wang
6,293,827 B1 9/2001 Stokoe et al.
6,299,483 B1 10/2001 Cohen et al.
6,299,484 B2 10/2001 Van Woensel et al.
6,302,711 B1 10/2001 Ito
6,319,075 B1 11/2001 Clark et al.
6,322,379 B1 11/2001 Ortega et al.
6,322,393 B1 11/2001 Doutrich et al.
6,328,602 B1 12/2001 Yamasaki et al.
6,338,635 B1 1/2002 Lee
6,343,955 B2 2/2002 Billman et al.
6,347,952 B1 2/2002 Hasegawa et al.
6,347,962 B1 2/2002 Kline
6,350,134 B1 2/2002 Fogg et al.
6,354,877 B1 3/2002 Shuey et al.
6,358,061 B1 3/2002 Regnier
6,361,366 B1 * 3/2002 Shuey et al. ..... 439/607.07
6,363,607 B1 4/2002 Chen et al.
6,364,710 B1 4/2002 Billman et al.
6,371,773 B1 4/2002 Crofoot et al.
6,375,474 B1 4/2002 Harper et al.
6,375,478 B1 4/2002 Kikuchi
6,379,188 B1 4/2002 Cohen et al.
6,386,914 B1 5/2002 Collins et al.
6,390,826 B1 5/2002 Affolter et al.
6,409,543 B1 6/2002 Astbury, Jr. et al.
6,414,248 B1 7/2002 Sundstrom
6,420,778 B1 7/2002 Sinyansky
6,431,914 B1 8/2002 Billman
6,435,914 B1 8/2002 Billman
6,457,983 B1 10/2002 Bassler et al.
6,461,202 B2 10/2002 Kline
6,464,529 B1 10/2002 Jensen et al.
6,471,548 B2 10/2002 Bertoncini et al.
6,482,038 B2 11/2002 Olson
6,485,330 B1 11/2002 Doutrich
6,494,734 B1 12/2002 Shuey
6,503,103 B1 1/2003 Cohen et al.
6,506,076 B2 1/2003 Cohen et al.
6,506,081 B2 1/2003 Blanchfield et al.
6,520,803 B1 2/2003 Dunn
6,526,519 B1 2/2003 Cuthbert
6,527,587 B1 3/2003 Ortega et al.
6,528,737 B1 3/2003 Kwong et al.
6,530,134 B1 3/2003 Laphan et al.
6,537,086 B1 3/2003 MacMullin
6,537,087 B2 3/2003 McNamara et al.
6,537,111 B2 3/2003 Brammer et al.
6,540,522 B2 4/2003 Sipe
6,540,558 B1 4/2003 Paagman
6,540,559 B1 4/2003 Kemmick et al.
6,547,066 B2 4/2003 Koch
6,551,140 B2 4/2003 Billman et al.
6,554,640 B1 4/2003 Koike et al.
6,554,647 B1 4/2003 Cohen et al.
6,561,849 B2 5/2003 Naito et al.
6,565,388 B1 5/2003 Van Woesel et al.
6,572,409 B2 6/2003 Nitta et al.
6,572,410 B1 6/2003 Volstorf et al.
6,589,071 B1 7/2003 Lias et al.
6,592,381 B2 * 7/2003 Cohen et al. ..... 439/80
6,607,402 B2 8/2003 Cohen et al.
6,609,933 B2 8/2003 Yamasaki
6,633,490 B2 10/2003 Centola et al.
6,641,411 B1 11/2003 Stoddard et al.
6,641,825 B2 11/2003 Scholz et al.
6,648,657 B1 11/2003 Korsunsky et al.
6,652,318 B1 11/2003 Winings et al.
6,659,808 B2 12/2003 Billman et al.
6,672,907 B2 1/2004 Azuma
6,692,272 B2 2/2004 Lemke et al.
6,695,627 B2 2/2004 Ortega et al.
6,712,646 B2 3/2004 Shindo
6,717,825 B2 4/2004 Volstorf
6,736,664 B2 5/2004 Ueda et al.
6,743,057 B2 6/2004 Davis
6,746,278 B2 6/2004 Nelson et al.
6,749,439 B1 6/2004 Potter et al.
6,749,468 B2 6/2004 Avery
6,762,067 B1 7/2004 Quinones et al.
6,764,341 B2 7/2004 Lappoehn
6,776,649 B2 8/2004 Pape et al.
6,786,771 B2 9/2004 Gailus
6,805,278 B1 10/2004 Olson et al.
6,808,399 B2 10/2004 Rothermel et al.
6,808,420 B2 10/2004 Whiteman, Jr. et al.
6,824,391 B2 11/2004 Mickievicz et al.
6,835,072 B2 12/2004 Simons et al.
6,843,679 B2 1/2005 Kuo et al.
6,843,686 B2 1/2005 Ohnishi et al.
6,848,944 B2 2/2005 Evans
6,851,974 B2 2/2005 Doutrich
6,851,980 B2 2/2005 Nelson et al.
6,852,567 B1 2/2005 Lee et al.
6,869,292 B2 3/2005 Johnescu et al.
6,872,085 B1 3/2005 Cohen et al.
6,884,117 B2 4/2005 Korsunsky et al.
6,890,214 B2 5/2005 Brown et al.
6,893,300 B2 5/2005 Zhou et al.
6,893,686 B2 5/2005 Egan
6,899,566 B2 * 5/2005 Kline et al. ..... 439/607.56
6,902,411 B2 6/2005 Kubo
6,913,490 B2 * 7/2005 Whiteman et al. ..... 439/607.05
6,918,776 B2 7/2005 Spink, Jr.
6,918,789 B2 7/2005 Lang et al.
6,932,649 B1 8/2005 Rothermel et al.
6,939,173 B1 9/2005 Elco et al.
6,945,796 B2 9/2005 Bassler et al.
6,951,466 B2 10/2005 Sandoval et al.
6,953,351 B2 10/2005 Fromm et al.
6,960,103 B2 11/2005 Tokunaga
6,969,280 B2 11/2005 Chien et al.
6,976,886 B2 12/2005 Winings et al.
6,979,215 B2 12/2005 Avery et al.
6,981,883 B2 1/2006 Raistrick et al.
6,988,902 B2 1/2006 Winings et al.
6,994,569 B2 2/2006 Minich et al.
7,001,188 B2 2/2006 Kobayashi
7,021,975 B2 4/2006 Lappohn
7,040,901 B2 5/2006 Benham et al.
7,044,794 B2 5/2006 Consoli et al.
7,090,501 B1 8/2006 Scherer et al.
7,094,102 B2 8/2006 Cohen et al.
7,097,506 B2 8/2006 Nakada
7,101,191 B2 9/2006 Benham
7,108,556 B2 9/2006 Cohen et al.
7,114,964 B2 10/2006 Winings et al.
7,118,391 B2 10/2006 Minich et al.
7,131,870 B2 11/2006 Whiteman, Jr. et al.
7,137,832 B2 11/2006 Mongold et al.
7,139,176 B2 11/2006 Taniguchi et al.
7,153,162 B2 12/2006 Mizumura et al.
7,172,461 B2 2/2007 Davis et al.
7,175,446 B2 2/2007 Bright et al.
7,179,108 B2 2/2007 Goodman et al.
7,186,123 B2 3/2007 Lemke et al.
7,207,807 B2 4/2007 Fogg
7,207,836 B2 4/2007 Tsai

(56) References Cited

U.S. PATENT DOCUMENTS

| | | | | |
|---|---|---|---|---|
| 7,239,526 | B1 | 7/2007 | Bibee | |
| 7,241,168 | B2 | 7/2007 | Sakurai et al. | |
| 7,247,050 | B1 | 7/2007 | Minich | |
| 7,270,574 | B1 | 9/2007 | Ngo | |
| 7,278,856 | B2 | 10/2007 | Minich | |
| 7,281,950 | B2 | 10/2007 | Belopolsky | |
| 7,285,018 | B2 | 10/2007 | Kenny et al. | |
| 7,292,055 | B2 | 11/2007 | Egitto et al. | |
| 7,310,875 | B2 | 12/2007 | Evans | |
| 7,322,855 | B2 | 1/2008 | Mongold et al. | |
| 7,331,802 | B2 | 2/2008 | Rothermel et al. | |
| 7,331,830 | B2 | 2/2008 | Minich | |
| 7,396,259 | B2 | 7/2008 | Marshall | |
| 7,407,387 | B2 | 8/2008 | Johnescu | |
| 7,429,176 | B2 | 9/2008 | Johnescu | |
| 7,431,616 | B2 | 10/2008 | Minich | |
| 7,438,600 | B1 | 10/2008 | Hung et al. | |
| 7,462,924 | B2 | 12/2008 | Shuey | |
| 7,467,955 | B2 * | 12/2008 | Raistrick et al. | 439/75 |
| 7,497,735 | B2 | 3/2009 | Belopolsky | |
| 7,497,736 | B2 | 3/2009 | Minich et al. | |
| 7,500,871 | B2 | 3/2009 | Minich et al. | |
| 7,524,209 | B2 | 4/2009 | Hull et al. | |
| 7,534,142 | B2 | 5/2009 | Avery et al. | |
| 7,553,182 | B2 | 6/2009 | Buck et al. | |
| 7,621,781 | B2 | 11/2009 | Rothermel et al. | |
| 7,670,185 | B2 | 3/2010 | Zhang et al. | |
| 7,798,861 | B2 | 9/2010 | Liu et al. | |
| 7,811,100 | B2 | 10/2010 | Stoner | |
| 7,916,488 | B2 | 3/2011 | Chang | |
| 2001/0012729 | A1 | 8/2001 | Van Woensel et al. | |
| 2001/0046810 | A1 * | 11/2001 | Cohen et al. | 439/608 |
| 2002/0039857 | A1 | 4/2002 | Naito | |
| 2002/0084105 | A1 | 7/2002 | Geng et al. | |
| 2002/0098727 | A1 | 7/2002 | McNamara | |
| 2002/0106930 | A1 | 8/2002 | Pape et al. | |
| 2002/0111068 | A1 | 8/2002 | Cohen et al. | |
| 2002/0127903 | A1 | 9/2002 | Billman et al. | |
| 2003/0116857 | A1 | 6/2003 | Taniguchi | |
| 2003/0143894 | A1 * | 7/2003 | Kline et al. | 439/608 |
| 2003/0171010 | A1 | 9/2003 | Winings et al. | |
| 2003/0203665 | A1 | 10/2003 | Ohnishi et al. | |
| 2003/0220021 | A1 | 11/2003 | Whiteman, Jr. et al. | |
| 2004/0157477 | A1 | 8/2004 | Johnson et al. | |
| 2004/0224559 | A1 | 11/2004 | Nelson et al. | |
| 2004/0235321 | A1 | 11/2004 | Mizumura et al. | |
| 2005/0009402 | A1 | 1/2005 | Chien et al. | |
| 2005/0032401 | A1 | 2/2005 | Kobayashi | |
| 2005/0048838 | A1 | 3/2005 | Korsunsky et al. | |
| 2005/0079763 | A1 | 4/2005 | Lemke et al. | |
| 2005/0101188 | A1 | 5/2005 | Benham et al. | |
| 2005/0118869 | A1 | 6/2005 | Evans | |
| 2005/0148239 | A1 | 7/2005 | Hull et al. | |
| 2005/0164555 | A1 | 7/2005 | Winings et al. | |
| 2005/0170700 | A1 | 8/2005 | Shuey et al. | |
| 2005/0196987 | A1 | 9/2005 | Shuey et al. | |
| 2005/0202722 | A1 | 9/2005 | Regnier | |
| 2005/0215121 | A1 | 9/2005 | Tokunaga | |
| 2005/0227552 | A1 | 10/2005 | Yamashita et al. | |
| 2005/0277315 | A1 | 12/2005 | Mongold et al. | |
| 2005/0287869 | A1 | 12/2005 | Kenny et al. | |
| 2006/0014433 | A1 | 1/2006 | Consoli et al. | |
| 2006/0024983 | A1 | 2/2006 | Cohen et al. | |
| 2006/0024984 | A1 | 2/2006 | Cohen et al. | |
| 2006/0046526 | A1 | 3/2006 | Minich et al. | |
| 2006/0051987 | A1 | 3/2006 | Goodman et al. | |
| 2006/0068610 | A1 | 3/2006 | Belopolsky | |
| 2006/0068641 | A1 | 3/2006 | Hull et al. | |
| 2006/0073709 | A1 | 4/2006 | Reid | |
| 2006/0116857 | A1 | 6/2006 | Sevic et al. | |
| 2006/0121749 | A1 | 6/2006 | Fogg | |
| 2006/0192274 | A1 | 8/2006 | Lee et al. | |
| 2006/0216969 | A1 | 9/2006 | Bright et al. | |
| 2006/0228912 | A1 | 10/2006 | Morlion et al. | |
| 2006/0232301 | A1 | 10/2006 | Morlion et al. | |
| 2007/0004287 | A1 | 1/2007 | Marshall | |
| 2007/0042639 | A1 | 2/2007 | Manter et al. | |
| 2007/0099455 | A1 | 5/2007 | Rothermel et al. | |
| 2007/0205774 | A1 | 9/2007 | Minich | |
| 2007/0207641 | A1 | 9/2007 | Minich | |
| 2008/0045079 | A1 | 2/2008 | Minich et al. | |
| 2008/0176453 | A1 | 7/2008 | Minich et al. | |
| 2009/0011641 | A1 | 1/2009 | Cohen et al. | |
| 2009/0017652 | A1 | 1/2009 | Stoner | |
| 2009/0017682 | A1 | 1/2009 | Amleshi et al. | |

FOREIGN PATENT DOCUMENTS

| | | |
|---|---|---|
| EP | 0 891 016 | 10/2002 |
| EP | 1 148 587 | 4/2005 |
| EP | 1635429 | 3/2006 |
| JP | 02-284372 | 11/1990 |
| JP | 03-266383 | 11/1991 |
| JP | 06-236788 | 8/1994 |
| JP | 07-114958 | 5/1995 |
| JP | 07-320818 | 12/1995 |
| JP | 11/185886 | 7/1999 |
| JP | 2000-003743 | 1/2000 |
| JP | 2000-003744 | 1/2000 |
| JP | 2000-003745 | 1/2000 |
| JP | 2000-003746 | 1/2000 |
| JP | 2004-103527 | 4/2004 |
| JP | 2004-355820 | 12/2004 |
| JP | 2005-190820 | 7/2005 |
| WO | WO90/16093 | 12/1990 |
| WO | W001/29931 | 4/2001 |
| WO | WO01/39332 | 5/2001 |
| WO | WO02/101882 | 12/2002 |
| WO | WO2006/031296 | 3/2006 |
| WO | WO2006/105535 | 10/2006 |
| WO | WO2008/082548 | 7/2008 |

OTHER PUBLICATIONS

U.S. Appl. No. 10/799,172, filed Feb. 11, 2004, Johnescu.

U.S. Appl. No. 10/940,329, filed Sep. 14, 2004, Johnescu.

4.0 UHD Connector: Differential Signal Crosstalk, Reflections, 1998, p. 8-9.

Airmax VS®, High Speed Connector System, Communications, Data, Consumer Division, 2004, 16 pages.

AMP Z-Pack 2mm HM Connector, 2mm Centerline, Eight-Row, Right-Angle Applications, Electrical Performance Report, EPR 889065, Issued Sep. 1998, 59 pages.

AMP Z-Pack 2mm HM Interconnection System, 1992 and 1994 © by AMP Incorporated, 6 pages.

AMP Z-Pack HM-Zd Performance at Gigabit Speeds, Tyco Electronics, Report #20GC014, Rev.B., May 4, 2001, 32 pages.

Amphenol TCS (ATCS): Backplane Connectors, 2002, www.amphenol-tcs.com, 3 pages.

Amphenol TCS (ATCS): Ventura® High Performance, Highest Density Available, 2002, www.amphenol-tcs.com, 2 pages.

Amphenol TCS (ATCS)-XCede® Connector, 2002, www.amphenol-tcs.com, 5 pages.

Amphenol TCS(ATCS): VHDM L-Series Connector, http://www.teradyne.com/prods/tcs/products/connectors/backplane/vhdm__1-series/index.html, 2006, 4 pages.

Amphenol TCS HDM® HDM Plus® Connectors, http://www.teradyne.com/prods/tcs/products/connectors/backplane/hdm/index.html, 2006, 1 page.

Backplane Products Overview Page, http://www.molex.com/cgi-bin/bv/molex/super__family/super__family.jsp?BV__Session ID=@, 2005-2006 © Molex, 4 pages.

Backplane Products, www.molex.com, 2007, 3 pages.

DesignCon, Interconnect Design Optimization and Characterization for Advanced High Speed Backplane Channel Links, Jan. 2009, 38 pages.

FCI's Airmax VS Connector System Honored at Design.con, 2005, Heilind Electrnoics, Inc., http://www.heilind.com/products/fci/airmax-vs-design.asp, 1 page.

Framatome Connector Specification, 1 page, May 10, 1999.

(56) References Cited

OTHER PUBLICATIONS

Fusi, M.A. et al., "Differential Signal Transmission through Backplanes and Connectors", *Electronic Packaging and Production,* Mar. 1996, 27-31.
GIG-ARRAY@ High Speed Mezzanine Connectors 15-40 mm Board to Board, Jun. 5, 2006, 1 page.
GIG-ARRAY® Connector System, Board to Board Connectors, 2005, 4 pages.
Goel, R.P. et al., "AMP Z-Pack Interconnect System", 1990, AMP Incorporated, 9 pages.
HDM/HDM *plus,* 2mm Backplane Interconnection System, Teradyne Connection Systems, © 1993, 22 pages.
Honda Connectors, Honda High-Speed Backplane Connector NSP Series, Honda Tsuschin Kogyo Co. Ltd. Development Engineering Division, Tokyo Japan, Feb. 7, 2003, 25 pages.
Hult, B., "FCI's Problem Solving Approach Changes Market, The FCI Electronics AirMax VS® ", ConnectorSupplier.com, Http://www.connectorsupplier.com/tech_updates_FCI-Airmax_archive.htm, 2006, 4 pages.
Lucent Technologies' Bell Labs and FCI Demonstrate 25gb/S Data Transmission over Electrical Backplane Connectors, Feb. 1, 2005, http://www.lucent.com/press/0205/050201.bla.html, 4 pages.
*Metral*™, "Speed & Density Extensions", *FCI,* Jun. 3, 1999, 25 pages.
MILLIPACS Connector Type A Specification, 1 page, Dec. 14, 2004.
Molex Incorporated Drawings, 1.0 HDMI Right Angle Header Assembly (19 PIN) Lead Free, Jul. 20, 2004, 7 pages.
Molex, Features and Specifications, www.molex.com/link/Impact.html, May 2008, 5 pages.
Molex, GbXI-Trac™ Backplane Connector System, www.molex.com/cgi-bin, 2007, 3 pages.
Molex, High Definition Multimedia Interface (HDMI), www.molex.com, 2 pages, 2008.
Nadolny, J. et al., "Optimizing Connector Selection for Gigabit Signal Speeds", ECN™, Sep. 1, 2000, http://www.ecnmag.com/article/CA45245, 6 pages.
SAMTEC, E.I.P. Extended Life Product, Open Pin Field Array Seaf Series, 2005, www.samtec.com, 1 page.
SAMTEC, High Speed Characterization Report, SEAM-30-02.0-S-10-2 Mates with SEAF-30-05.0-S-10-2, Open Pin Field Array, 1.27 mm×1.27mm Pitch 7mm Stack Height, 2005, www.samtec.com, 51 pages.
TB-2127 "VENTURA™ Application Design", Revision, "General Release", Specification Revision Status-B. Hurisaker, Aug. 25, 2005, Amphenol Coproation 2006, 1-13.
Tyco Electronics Engineering Drawing, Impact, 3 Pair 10 Column Signal Module, Mar. 25, 2008, 1 page.
Tyco Electronics Engineering Drawing, Impact, 3 Pair Header Unguided Open Assembly, Apr. 11, 2008, 1 page.
Tyco Electronics Z-Dok+ Connector, May 23, 2003, http://zdok.tycoelectronics.com, 15 pages.
Tyco Electronics, "Champ Z-Dok Connector System", Catalog # 1309281, Issued Jan. 2002, 3 pages.
Tyco Electronics, High Speed Backplane Interconnect Solutions, Feb. 7, 2003, 6 pages.
Tyco Electronics, Impact™ Connector Offered by Tyco Electronics, High Speed Backplane Connector System, Apr. 15, 2008, 12 pages.
Tyco Electronics, Overview for High Density Backplane Connector (Z-Pack TinMan), 2005, 1 page.
Tyco Electronics, Overview for High Density Backplane Connectors (Impact™) Offered by Tyco Electronics, www.tycoelectronics.com/catalog, 2007, 2 pages.
Tyco Electronics, Two-Piece, High-Speed Connectors, www.tycoelectronics.com/catalog, 2007, 3 pages.
Tyco Electronics, Z-Dok and Connector, Tyco Electronics, Jun. 23, 2003, http://2dok.tyco.electronics.com, 15 pages.
Tyco Electronics, Z-Pack Slim UHD, http://www.zpackuhd.com, 2005, 8 pages.
Tyco Electronics, Z-Pack TinMan Product Portofolio Expanded to Include 6-Pair Module, 2005, 1 page, Jun. 17, 2008.
Tyco Electronics/AMP, "Z-Dok and Z-Dok and Connectors", Application Specification # 114-13068, Aug. 30, 2005, Revision A, 16 pages.
Tyco Unveils Z-Pack TinMan Orthogonal Connector System, http://www.epn-online.com/page/new59327/tyco-unveils-z-pack-orthogonal-conn, Oct. 13, 2009, 4 pages.
VHDM Daughterboard Connectors Feature press-fit Terminations and a No-Stubbing Seperable Interface, © Teradyne, Inc. Connections Systems Division, Oct. 8, 1997, 46 pages.
Z-Pack TinMan High Speed Orthogonal Connector Product Feature Selector, http://catalog.tycoelectronics.com/catalog/feat/en/s/24643?BML=10576.17560.17759, Oct. 13, 2009, 2 pages.
International Search Report, International Application No. PCT/US2008/002569, Publication No. WO2008/108951, International Filing Date: Sep. 26, 2008, 3 pages.
In U.S. Appl. No. 11/713,503, filed Mar. 2, 2007, Notice of Abandonment dated Sep. 11, 2009, 2 pages.
In U.S. Appl. No. 11/713,503, filed Mar. 2, 2007, Advisory Action dated May 5, 2009, 3 pages.
In U.S. Appl. No. 11/713,503, filed Mar. 2, 2007, Final Office Action dated Feb. 27, 2009, 4 pages.
In U.S. Appl. No. 11/713,503, filed Mar. 2, 2007, Non-Final Office Action dated Nov. 6, 2008, 4 pages.
In U.S. Appl. No. 11/713,503, filed Mar. 2, 2007, Notice of Publication dated Sep. 4, 2008, 1 page.
In U.S. Appl. No. 11/713,503, filed Mar. 2, 2007, Non-Final Office Action dated Jun. 20, 2008, 5 pages.
In U.S. Appl. No. 11/713,503, filed Mar. 2, 2007, (Tyco) Declaration under 37 1.132, 11 pages.
In U.S. Appl. No. 11/713,503, filed Mar. 2, 2007, Request for Consideration After Final dated Apr. 24, 2009, 4 pages.
In U.S. Appl. No. 11/713,503, filed Mar. 2, 2007, Response to Office Action dated Nov. 6, 2008, mailed Feb. 6, 2009, 5 pages.
In U.S. Appl. No. 11/713,503, filed Mar. 2, 2007, Response to Office Action dated Jun. 20, 2008, mailed Sep. 22, 2008, 4 pages.
"Amphenol TCS (ATCS) VHDM® Connector" http://www.teradyne.com/prods/tcs/products/connectors/backplane/vhdm/index.html, Jan. 31, 2006, 2 pages.
"Amphenol TCS (ATCS): HDM® Stacker Signal Integrity", http://www.teradyne.com/prods/tcs/products/connectors/mezzanine/hdm_stacker/signintegr, Feb. 2, 2006, 3 pages.
"B.? Bandwidth and Rise Time Budgets", Module 1-8 Fiber Optic Telecommunications (E-XVI-2a), http://cord.org.step_online/st1-8/st18exvi2a.htm, Feb. 27, 2006, 3 pages.
"Communications, Data, Consumer Division: Mezzanine High-Speed High-Density Connectors Gig-Array® and Meg-Array® Electrical Performance Data", Mezzanine Electrical Comparison, Jun. 5, 2008, 40 pages.
"Daughtercard Connector Assembly", Teradyne Connection Systems, Inc., Customer Use Drawing, C-163-5101-500 Rev 4, Dec. 6, 2001, 1 page.
"HDM Separable Interface Detail", Molex®, Oct. 7, 1997, 3 pages.
"VHDM High-Speed Differential (VHDM HSD)", http://www.teradyne.com/prods/bps/vhdm/hsd.html, Jan. 24, 2000, 6 pages.
Berg Electronics, "PCB-Mounted Receptacle Assemblies 2.00mm (0.079 in.) Centerlines Right Angle Solder-to-Board Signal Receptacle", Metral™, Jan. 1, 1998, 2 pages.
FCI Framatome Group, "Metral® 2mm High-Speed Connectors 1000, 2000, 3000 Series", Electrical Performance Data for differential Applications, Jan. 1, 2000, 2 pages.
NSP Series, "Backplane High-Speed Data Transmission Cable Connectors", http://www.honda-connectors.co.jp, Feb. 3, 2003, 6 pages with English Translation.

* cited by examiner

ATTACHMENT SYSTEM FOR ELECTRICAL CONNECTOR

CROSS-REFERENCE TO RELATED APPLICATIONS

This claims priority to U.S. Patent Application No. 61/261,097 filed Nov. 13, 2009, the disclosure of which is hereby incorporated by reference as if set forth in its entirety herein.

This application is related to U.S. patent application Ser. No. 12/722,797 filed on Mar. 12, 2010 and U.S. patent application Ser. No. 12/908,344 filed Oct. 20, 2010, the disclosure of each of which is hereby incorporated by reference as if set forth in its entirety herein.

BACKGROUND

Electrical connectors provide signal connections between electronic devices using signal contacts. It is sometimes desirable to increase data transfer through an existing connector without changing or increasing the physical dimensions (height, width, depth, mating interface, mounting interface) of the connector. Devices are often installed in an electrical connector to increase electrical performance. Unfortunately, signal contacts can be so closely spaced that undesirable interference, or "cross talk," occurs between adjacent signal contacts. Cross talk occurs when a signal in one signal contact induces electrical interference in an adjacent signal contact due to interfering electrical fields, thereby compromising signal integrity. Cross talk may also occur between differential signal pairs, and increases with reduced distance between the interfering signal contacts. Cross talk may be reduced by separating adjacent signal contacts or adjacent differential signal pairs with ground contacts. Conventionally, metallic crosstalk shields have been added to an electrical connector to further reduce crosstalk. For instance, external plates in the form of crosstalk shields can be placed between adjacent insert molded leadframe assembles (IMLAs).

Typical attachment mechanisms for securing an external plate to an adjacent IMLA include an opening formed in the plate that receives a molded post of the IMLA. Unfortunately, it has been found that the opening formed in the plate can detrimentally affect the signal integrity during operation of the connector. For instance, cross talk can occur between adjacent IMLAs due to unshielded electrical fields extending through the openings formed in the plate.

SUMMARY

In accordance with one embodiment, an electrical connector includes a dielectric leadframe housing defining a first outer engagement surface, and a plurality of electrical contacts carried by the dielectric leadframe housing. The electrical connector further includes an external electrical component including a body that defines a second outer engagement surface configured to be attached to the dielectric leadframe housing such that the first and second outer engagement surfaces face each other. The electrical connector further includes an attachment system including a first engagement member carried by the first outer surface of the dielectric leadframe housing and a second engagement member carried by the body of the external electrical component. The first and second engagement members are configured to mate so as to lock the external electrical component to the leadframe housing, thereby resisting of the external electrical component from the leadframe housing. The second engagement member of the external electrical component is devoid of apertures that extend through the external electrical component.

BRIEF DESCRIPTION OF THE DRAWINGS

The foregoing summary, as well as the following detailed description of preferred embodiments of the application, will be better understood when read in conjunction with the appended drawings. For the purposes of illustrating the embodiments of the present application, there is shown in the drawings preferred embodiments. It should be understood, however, that the application is not limited to the precise arrangements and instrumentalities shown. In the drawings.

DETAILED DESCRIPTION

An electrical connector can include a plurality of leadframe assemblies generally of the type described in U.S. patent application Ser. No. 12/396,086, filed Mar. 2, 2009, which hereby incorporated by reference as if set forth in its entirety herein.

Figure 1:
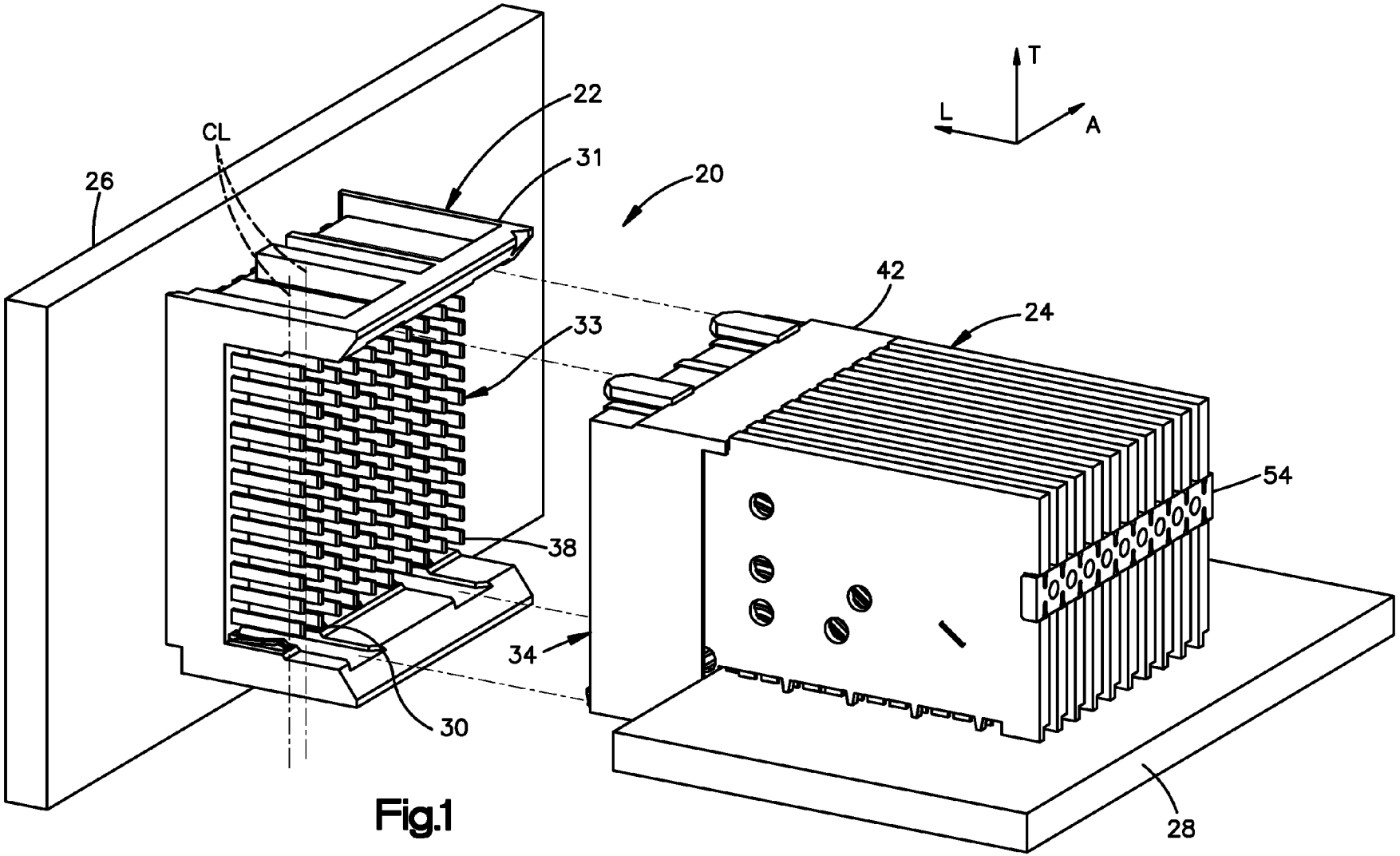
FIG. 1 is a perspective view of an electrical connector assembly including a vertical header connector and a right-angle receptacle connector mounted to respective substrates.
Figure 2A:
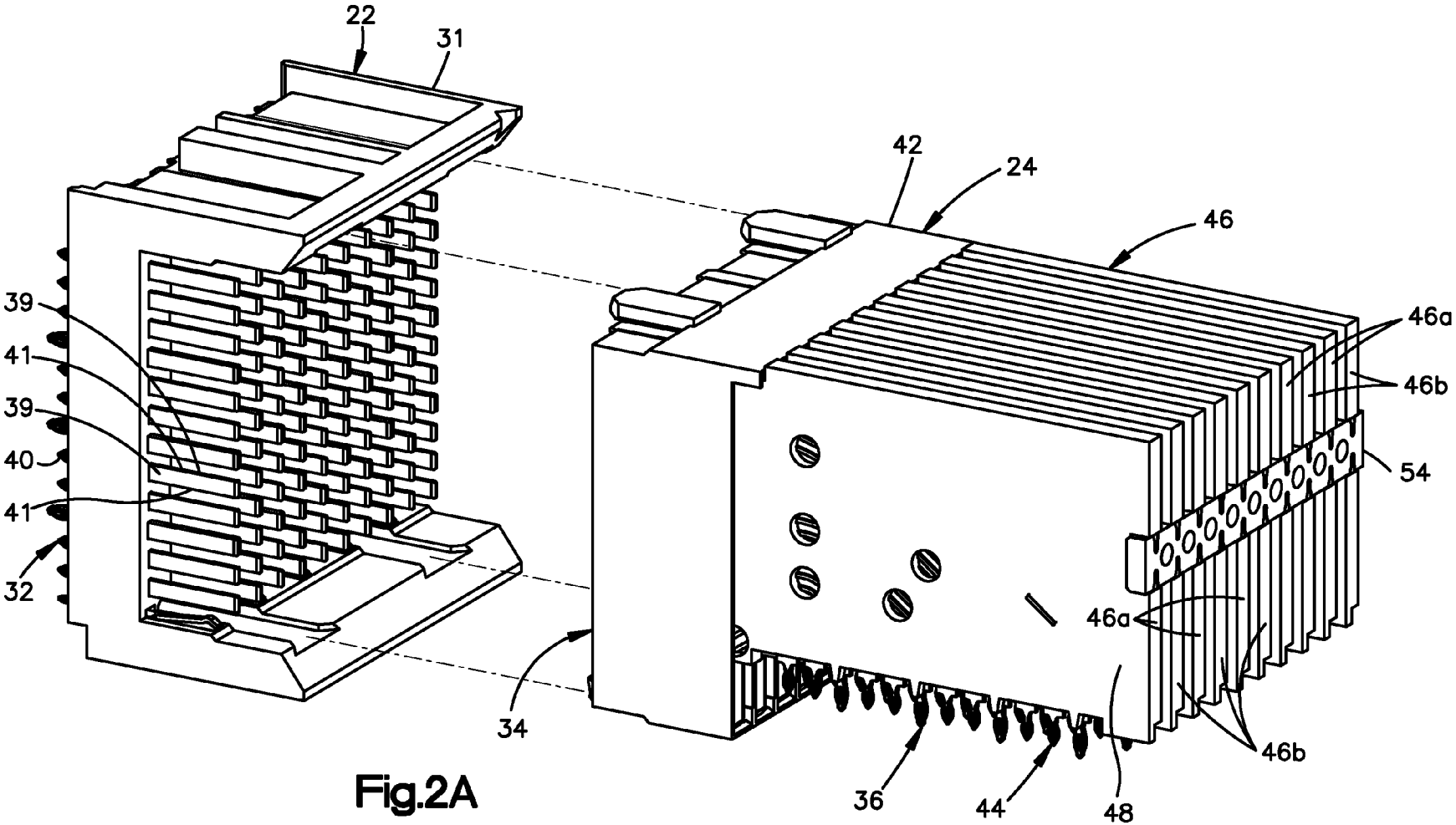
FIG. 2A is a perspective view of the electrical connector assembly similar to FIG. 1, but without the substrates.
Figure 2B:
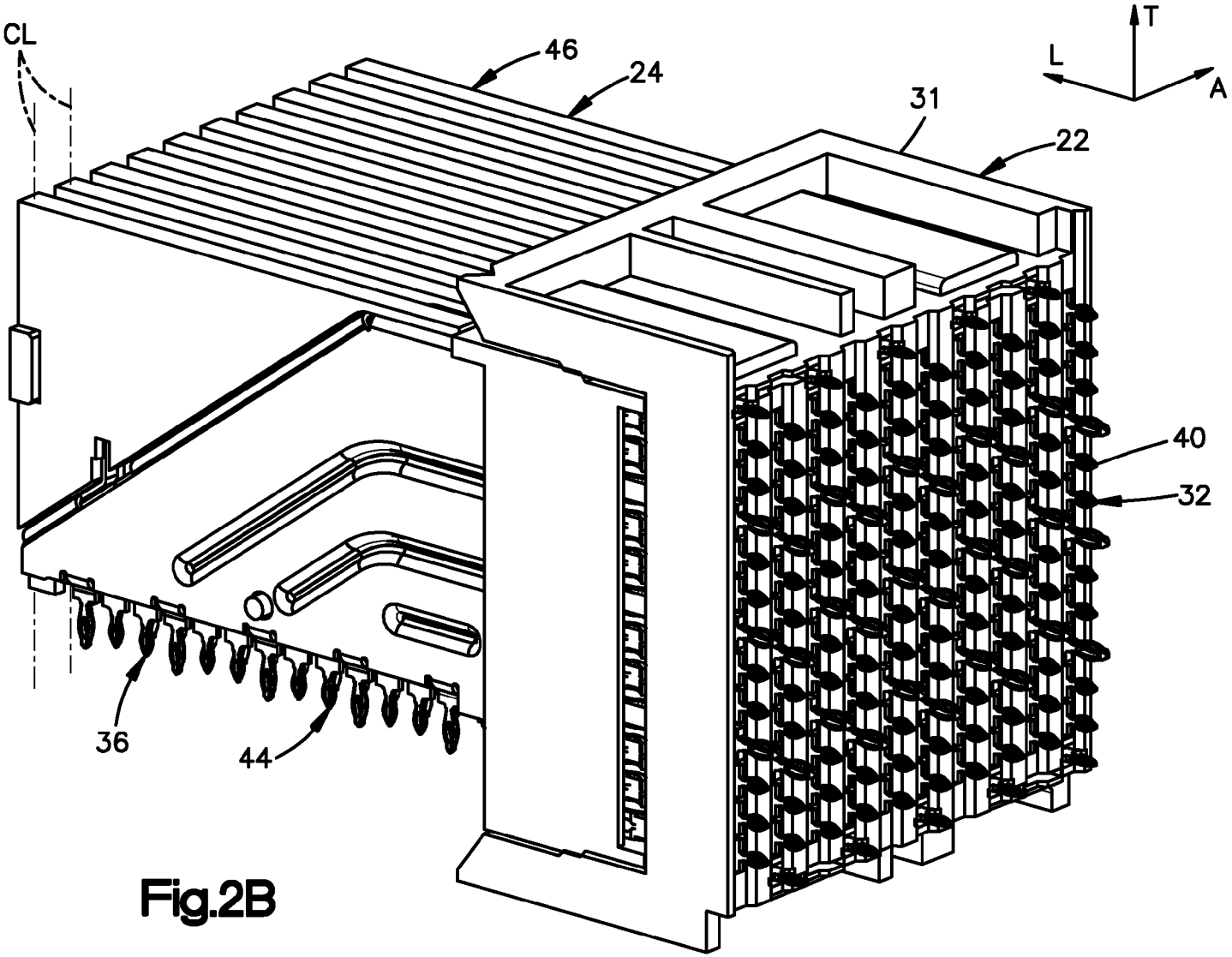
FIG. 2B is another perspective view of the electrical connector assembly as illustrated in FIG. 2A, but showing the electrical connectors in a mated configuration.

Referring initially to FIGS. 1-2B, an electrical connector assembly 20 includes a first electrical connector 22 and a second electrical connector 24 configured to mate with each other so as to establish an electrical connection between complementary electrical components, such as substrates 26 and 28. In accordance with the illustrated embodiment, each substrate 26 and 28 defines a printed circuit board (PCB). As shown, the first electrical connector 22 can be a vertical connector defining a mating interface 30 and a mounting interface 32 that extends substantially parallel to the mating interface 30. The second electrical connector 24 can be a right-angle connector defining a mating interface 34 and a mounting interface 36 that extends substantially perpendicular to the mating interface 34.

The first electrical connector 22 includes a dielectric housing 31 that carries a plurality of electrical contacts 33, which can include signal contacts and ground contacts. The electrical contacts 33 may be insert molded prior to attachment to the housing 31 or stitched into the housing 31. The electrical contacts 33 define respective mating ends 38 that extend along the mating interface 30, and mounting ends 40 that extend along the mounting interface 32. Each of the electrical contacts 33 can define respective first and second opposed broadsides 39 and first and second edges 41 connected between the broadsides. The edges 41 define a length less than that of the broadsides 39, such that the electrical contacts 33 define a rectangular cross section. The mounting ends 40 may be press-fit tails, surface mount tails, or fusible elements such as solder balls, which are configured to electrically connect to a complementary electrical component such as the substrate 26, which can be configured as a backplane, midplane, daughtercard, or the like.

At least one or more pairs of adjacent electrical contacts 33 can be configured as differential signal pairs 45. In accordance with one embodiment, the differential signal pairs 45 are edge coupled, that is the edges 39 of each electrical contact 33 of a given differential pair 45 face each other along a common column CL. Thus, the electrical connector 22 can include a plurality of differential signal pairs arranged along a given column CL. As illustrated, the electrical connector 22 can include four differential signal pairs 45 positioned edge-to-edge along the column CL, though the electrical connector 22 can include any number of differential signal pairs along a given centerline as desired, such as two, three, four, five, six, or more differential signal pairs.

Because the mating ends 38 of the electrical contacts 33 are configured as plugs, the first electrical connector 22 can be referred to as a plug or header connector. Furthermore, because the mating interface 26 is oriented substantially parallel to the mounting interface 32, the first electrical connector 22 can be referred to as a vertical connector, though it should be appreciated that the first electrical connector can be provided in any desired configuration so as to electrically connect the substrate 28 to the second electrical connector 24. For instance, the first electrical connector 22 can be provided as a receptacle connector whose electrical contacts are configured to receive plugs of a complementary electrical connector that is to be mated. Additionally, the first electrical connector 22 can be configured as a right-angle connector, whereby the mating interface 30 is oriented substantially perpendicular to the mounting interface 32, and co-planar with the mounting interface 32.

Referring now to FIGS. 1-3E, the second electrical connector 24 includes a dielectric housing 42 that retains a plurality of electrical contacts such as electrical signal contacts 44. In accordance with the illustrated embodiment, the housing 42 retains a plurality of leadframe assemblies 46 that are arranged along a lateral row direction. The plurality of leadframe assemblies 46 can include a first plurality of leadframe assemblies 46*a* each having a first electrical contact arrangement, and a second plurality of leadframe assemblies 46*b* each having a second electrical contact arrangement that differs from the first having a contact arrangement that differs from the first electrical contact arrangement. Alternatively, the leadframe assemblies 46 can be identically constructed or first and second pluralities of leadframe assemblies 46*a* and 46*b* can be arranged in any pattern as desired across the row of leadframe assemblies 46. Each leadframe assembly 46 can be constructed in general as described in U.S. patent application Ser. No. 12/396,086; however one or more up to all of the leadframe assemblies 46 can include an electrically conductive plate such as a ground plate 62 that replaces discrete ground contacts, as described in more detail below. Each leadframe assembly 46 thus includes a dielectric leadframe housing 48 that carries a plurality of electrical signal contacts 44 arranged along a common transverse column CL, and further carries the ground plate 62. Any suitable dielectric material, such as air or plastic, may be used to isolate the electrical signal contacts 44 from one another. The leadframe housing 48 of each leadframe assembly 46 defines laterally opposed first and second outer surfaces 58 and 56, respectively The electrical signal contacts 44 define a respective receptacle mating ends 50 that extend along the mating interface 34, and opposed mounting ends 52 that extend along the mounting interface 36. Each mating end 50 extends horizontally forward along a longitudinal or first direction L, and each mounting end 52 extends vertically down along a transverse or second direction T that is substantially perpendicular to the longitudinal direction L. The leadframe assemblies 46 are arranged adjacent each other along a lateral or third direction A that is substantially perpendicular to both the transverse direction T and the longitudinal direction L.

Thus, as illustrated, the longitudinal direction L and the lateral direction A extend horizontally as illustrated, and the transverse direction T extends vertically, though it should be appreciated that these directions may change depending, for instance, on the orientation of the electrical connector 24 during use. Unless otherwise specified herein, the terms "lateral," "longitudinal," and "transverse" are used to describe the perpendicular directional components of various components. The terms "inboard" and "inner," and "outboard" and "outer" with respect to a specified directional component are used herein with respect to a given apparatus to refer to directions along the directional component toward and away from the center apparatus, respectively.

The receptacle mounting ends 52 may be constructed similar to the mounting ends 40 of the electrical contacts 33, and thus may include press-fit tails, surface mount tails, or fusible elements such as solder balls, which are configured to electrically connect to a complementary electrical component such as the substrate 28, which can be configured as a backplane, midplane, daughtercard, or the like. The mating ends 50 are configured to electrically connect to the mating ends 38 of the complementary electrical contacts 33 when the electrical connectors 22 and 24 are mated. Each of the electrical signal contacts 44 can define respective first and second opposed broadsides 49 and first and second edges 51 connected between the broadsides 49. The edges 51 define a length less than that of the broadsides 49, such that the electrical signal contacts 44 define a rectangular cross section.

The mating end 50 of each signal contact 44 can include a neck 37 that extends out from the leadframe housing 48 along a longitudinally forward direction. The longitudinally forward direction can also be referred to an insertion or mating direction, as the connectors 22 and 24 can be mated when the electrical connector 24 is brought toward the electrical connector 22 when the electrical connector 24 is brought toward the electrical connector 22 in the longitudinally forward direction. The neck 37 can be laterally curved in a direction toward the outer surface 58 of the leadframe housing 48, so as to be generally aligned with corresponding mating ends 66 of the ground plate 62 (see FIG. 5A) as is described in more detail below. Each signal contact 44 can further include a pair of transversely split fingers 43 that extend longitudinally outward, or forward, from the neck 37. The split fingers 43 can be curved and configured to mate with the mating ends 38 of the electrical contacts 33 of the first electrical connector 22. The split fingers 43 can be flexible, and can flex when mated with the mating ends 38 so as to provide a normal force.

The mounting end 52 of each signal contact 44 can define a neck 53 that extends transversely down from the leadframe housing 48, and a mounting terminal 55 that extends down from the neck 53. The neck 53 and/or the mounting terminal 55 can be angled or curved toward the outer surface 58, and thus toward the ground plate 62. The mounting terminal 55 can define an eye-of-the-needle or any suitable alternative shape configured to electrically connect to the substrate 26. For instance, the mounting terminals 55 can be pressed into vias that extend into the substrate 26 so as to be placed in electrical communication with electrical traces that run along or through the substrate 26.

The electrical signal contacts 44 may define a lateral material thickness of about 0.1 mm to 0.5 mm and a transverse height of about 0.1 mm to 0.9 mm. The contact height may vary over the length of the right angle electrical signal contacts 44. The electrical contacts 44 can be spaced apart at any distance as desired, as described in U.S. patent application Ser. No. 12/396,086. The second electrical connector 24 also may include an IMLA organizer 54 that may be electrically insulated or electrically conductive, and retains the IMLAs or lead frame assemblies 46.

At least one or more pairs of adjacent electrical signal contacts 44 can be configured as differential signal pairs 45. In accordance with one embodiment, the differential signal pairs 45 are edge coupled, that is the edges 51 of each electrical contact 44 of a given differential pair 45 face each other along a common transverse column CL. Thus, the electrical connector 22 can include a plurality of differential signal pairs 45 arranged along a given column CL. As illustrated, the electrical connector 22 can include four differential signal pairs 45 positioned edge-to-edge along the column CL, though the electrical connector 24 can include any number of differential signal pairs along a given centerline as desired, such as two, three, four, five, six, or more differential signal pairs.

Because the mating ends 50 and the mounting ends 52 are substantially perpendicular to each other, the electrical signal contacts 44 can be referred to as right-angle electrical contacts. Similarly, because the mating interface 30 is substantially parallel to the mounting interface 32, the second electrical connector 24 can be provided as a vertical header connector. Moreover, because the mating ends 50 are configured to receive the mating ends 38 of the complementary electrical contacts 33 configured as plugs, the electrical signal contacts 44 can be referred to as receptacle contacts. It should be appreciated, however, that the second electrical connector 24 can be provided in any desired configuration so as to electrically connect the substrate 28 to the first electrical connector 22. For instance, the second electrical connector 24 can be configured as a header connector, and can be further be configured as a vertical connector as desired. When the connectors 22 and 24 are mounted to their respective substrates 26 and 28 and mated with each other, the substrates 26 and 28 are placed in electrical communication.

The first and second electrical connectors 22 and 24 may be shieldless high-speed electrical connectors, i.e., connectors that operate without metallic crosstalk plates between adjacent columns of electrical contacts, and can transmit electrical signals across differential pairs at data transfer rates at or above four Gigabits/sec, and typically anywhere at or between 6.25 through 12.5 Gigabits/sec or more (about 80 through 35 picosecond rise times) with acceptable worst-case, multi-active crosstalk on a victim pair of no more than six percent. Worst case, multi-active crosstalk may be determined by the sum of the absolute values of six or eight aggressor differential signal pairs that are closest to the victim differential signal pair, as described in U.S. Pat. No. 7,497,736. Each differential signal pair may have a differential impedance of approximately 85 to 100 Ohms, plus or minus 10 percent. The differential impedance may be matched, for instance, to the respective substrates 26 and 28 to which the electrical connectors 22 and 24 may be attached. The connectors 22 and 24 may have an insertion loss of approximately −1 dB or less up to about a five-Gigahertz operating frequency and of approximately −2 dB or less up to about a ten-Gigahertz operating frequency.

With continuing reference to FIGS. 3A-3E, the leadframe housing 48 of each leadframe assembly 46 defines laterally opposed first and second outer surfaces 58 and 56, respectively. The leadframe housing 48 can be made of any suitable dielectric material such as plastic, and carries the right-angle electrical signal contacts 44. The leadframe assemblies 46 can be configured as insert molded leadframe assemblies (IMLAs), whereby the electrical signal contacts 44 are overmolded by the leadframe housing 48 in accordance with the illustrated embodiment. Alternatively, the electrical signal contacts 44 of the leadframe assemblies 46 can be stitched or otherwise attached in the leadframe housing 48. Each electrical signal contact 44 defines a mating end 50 and a mounting end 52 as described above. The mating ends 50 are aligned along the transverse direction T, and the mounting ends 52 are aligned along the longitudinal direction L. The signal contacts 44 are arranged in pairs 45, which can be differential signal pairs. Alternatively, the signal contacts 44 can be provided as single-ended signal contacts. Selected ones of the signal contacts 44, such as one or more up to all of adjacent pairs 45 of signal contacts 44, are separated by a gap 60. The electrical signal contacts 44 are further disposed in the leadframe housing 48 such that the gap 60 spaces the upper electrical signal contact 44 from the upper end of the leadframe assembly 46*a*.

Figure 5A:
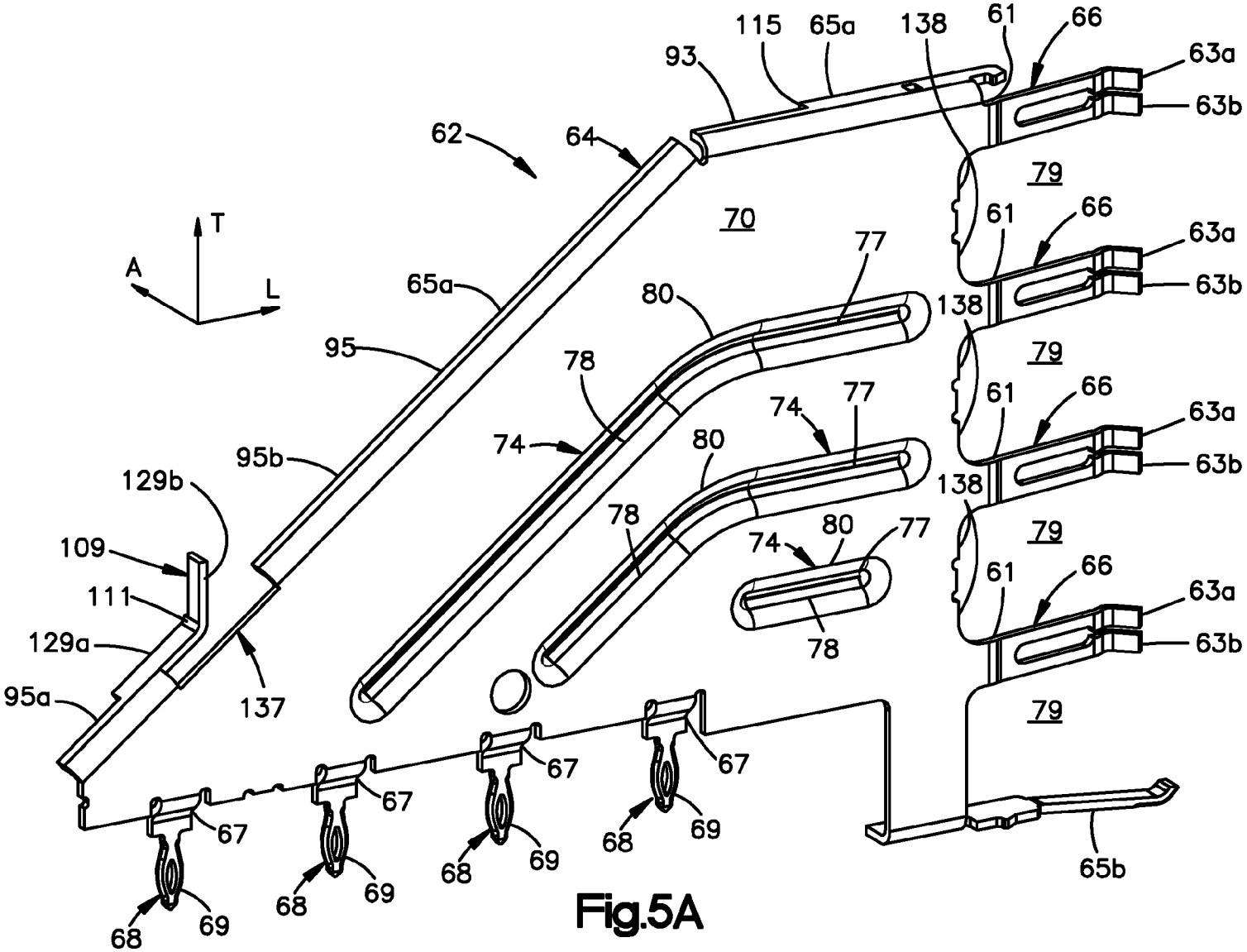
FIG. 5A is a perspective view of the ground plate illustrated in FIG. 2A, showing at least one alignment members and at least one attachment member.
Figures 5B, 6:
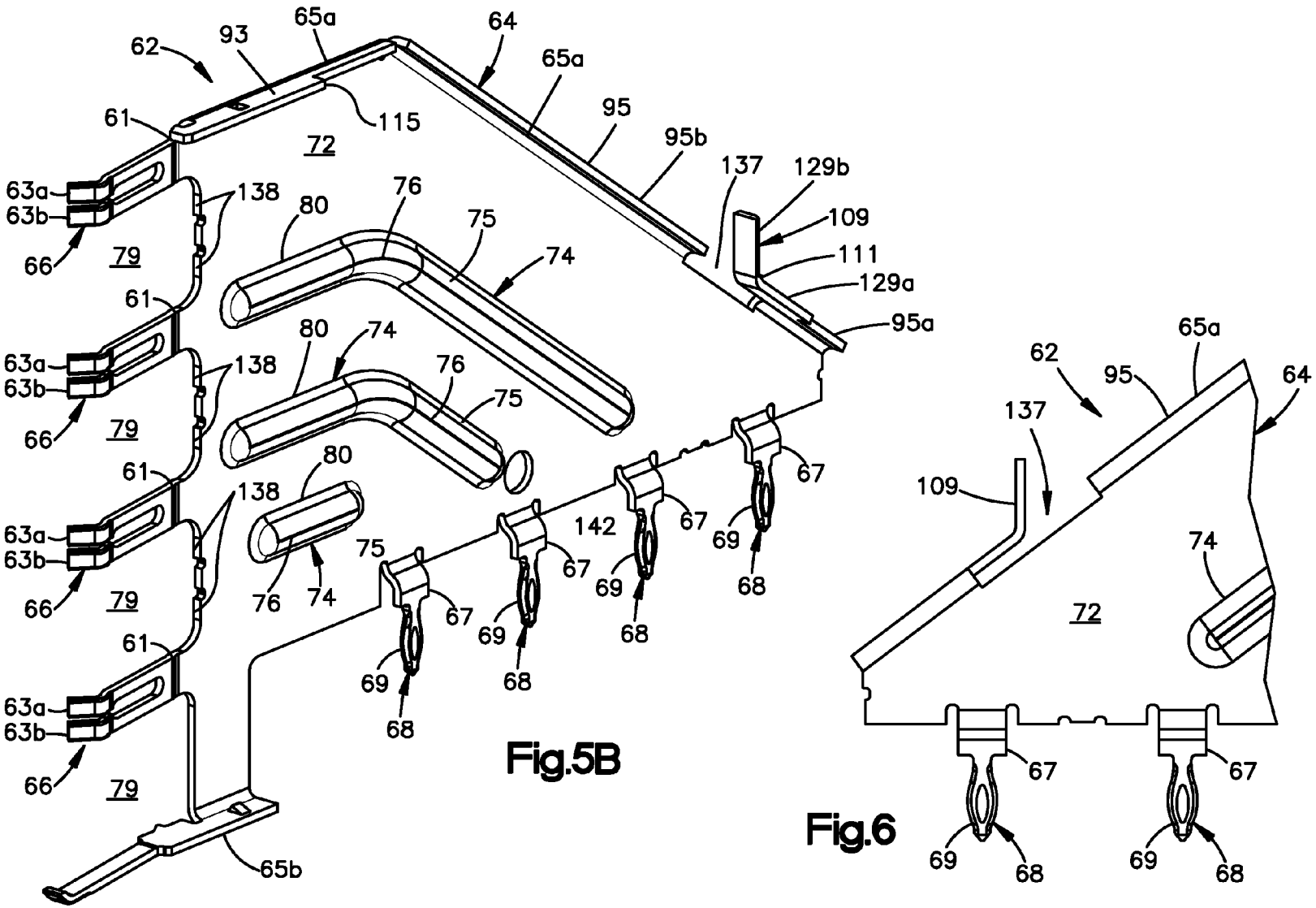
FIG. 5B is another perspective view of the ground plate illustrated in FIG. 5A.
FIG. 6 is an enlarged partial perspective view of a portion of the ground plate illustrated in FIG. 5A, showing the at least one attachment member.

Referring also to FIGS. 5A-B, each leadframe assembly 46 further includes an electrical component that is external with respect to the ground plate 62 that can be attached to the leadframe housing 48. The external electrical component can be an external plate 57 constructed as described herein with respect to the ground plate 62 having a body such as a ground plate body 64. The ground plate 62 defines ground mating ends 66 that are configured to mate with complementary ground contacts of the electrical connector 22, and opposed ground mounting ends 68 that are configured to connect to the substrate 26. The ground plate 62 defines a plurality of gaps 79 disposed between adjacent mating ends 66. Thus, referring also to FIG. 3, the leadframe assembly 46 defines a mating end 82 that includes the mating ends 66 of the ground plate 62 and the mating ends 50 of the electrical signal contacts 44, and a mounting end 84 that includes the mounting ends 52 of the electrical signal contacts 44 and the mounting ends 68 of the ground plate 62. The mating end 82 is disposed proximate to the mating interface 34 of the electrical connector 24, and the mounting end 84 is disposed proximate to the mounting interface 36 of the electrical connector. Thus, the mating end 82 is oriented substantially perpendicular with respect to the mounting end 84 as described above. The ground plate 62 is further configured to provide an electrical shield between differential signal pairs 45 of adjacent columns CL. The ground plate 62 can be formed from any suitable electrically conductive material, such as a metal, and includes a body illustrated as a ground plate body 64, a plurality of mating ends 66 extending forward from the ground plate body 64, and a plurality of mounting ends 68 extending down from the body.

With continuing reference to FIGS. 3A-5B, the mating ends 66 and mounting ends 68 can be constructed as described above with respect to the mating ends 50 and mounting ends 52 of the electrical signal contacts 44. In accordance with the illustrated embodiment, each mating end 66 of the ground plate 62 can include a neck 61 that extends longitudinally forward from the ground plate body 64. The neck 61 can be laterally curved in a direction toward the signal contacts 44 of the leadframe assembly 46, such that the mating ends 66 are generally aligned with the corresponding mating ends 50 of the signal contacts 44. Accordingly, the mating ends 66 and 50 are configured to mate with the mating ends 38 of the electrical contacts of the complementary first electrical connector 22. Each mating end 66 of the ground plate 62 can further include a pair of transversely split fingers including a first or upper finger 63*a* and a second or lower finger 63*b* that each extends longitudinally forward, from the neck 61. The fingers 63*a* and 63*b* can be curved and configured to mate with the mating ends 38 of the electrical contacts 33. The fingers 63*a* and 63*b* can be flexible so as to flex when mated with the mating ends 38 so as to provide a normal force. The fingers 63*a* and 63*b* can extend further longitudinally forward than the fingers 43 of the electrical signal contacts 44, or the same distance as the fingers 43 of the electrical signal contacts 44. Each mating end 66 defines a distal end 71 that extends out from the ground plate body 64.

Each mounting end 68 of the ground plate 62 can define a neck 61 that extends transversely down from the ground plate body 64, and a mounting terminal 69 that extends down from the neck 61. The neck 61 extends laterally inward towards the electrical contacts 44, such that the mounting terminals 69 of the ground plate 62 are aligned with the mounting terminals 55 of the signal contacts 44. The mounting terminals 69 can define an eye-of-the-needle or any suitable alternative shape configured to electrically connect to the substrate 26. For instance, the mounting terminals 69 can be pressed into vias that extend into the substrate 26 so as to be placed in electrical communication with electrical traces that run along or through the substrate 26.

Figure 3A:
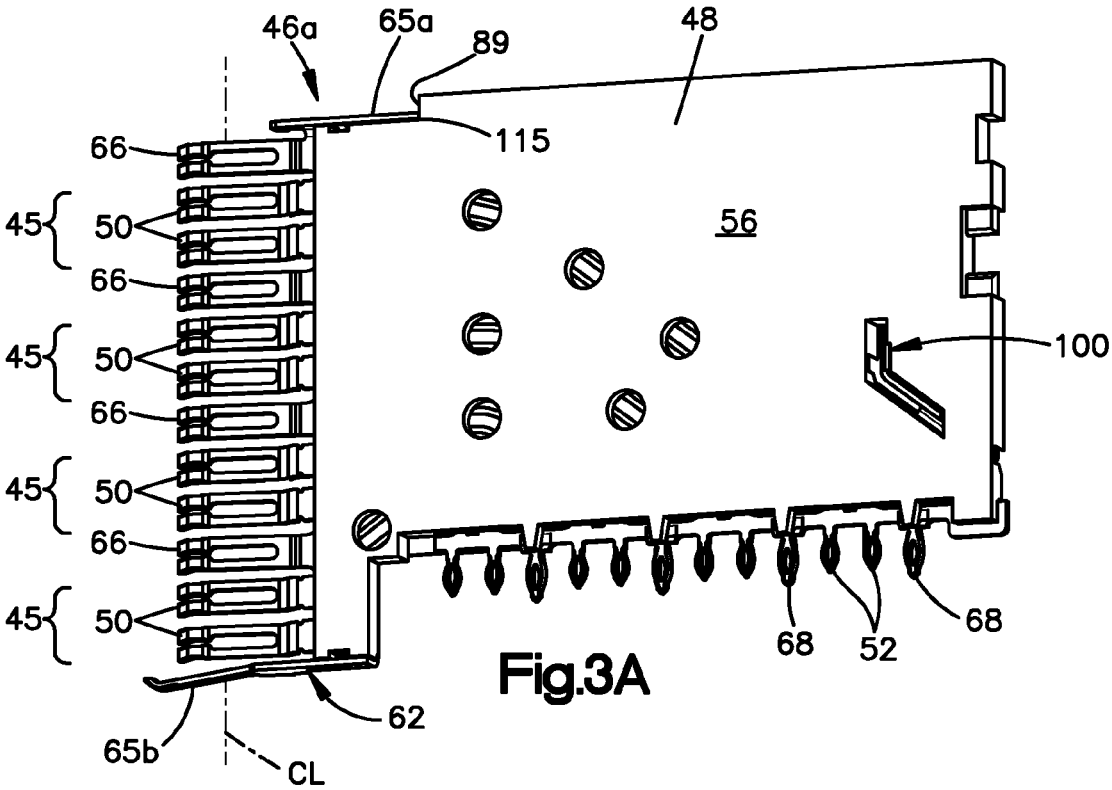
FIG. 3A is a perspective view of one of a first plurality of leadframe assemblies of the right-angle electrical connector illustrated in FIGS. 2A-B.
Figure 3B:
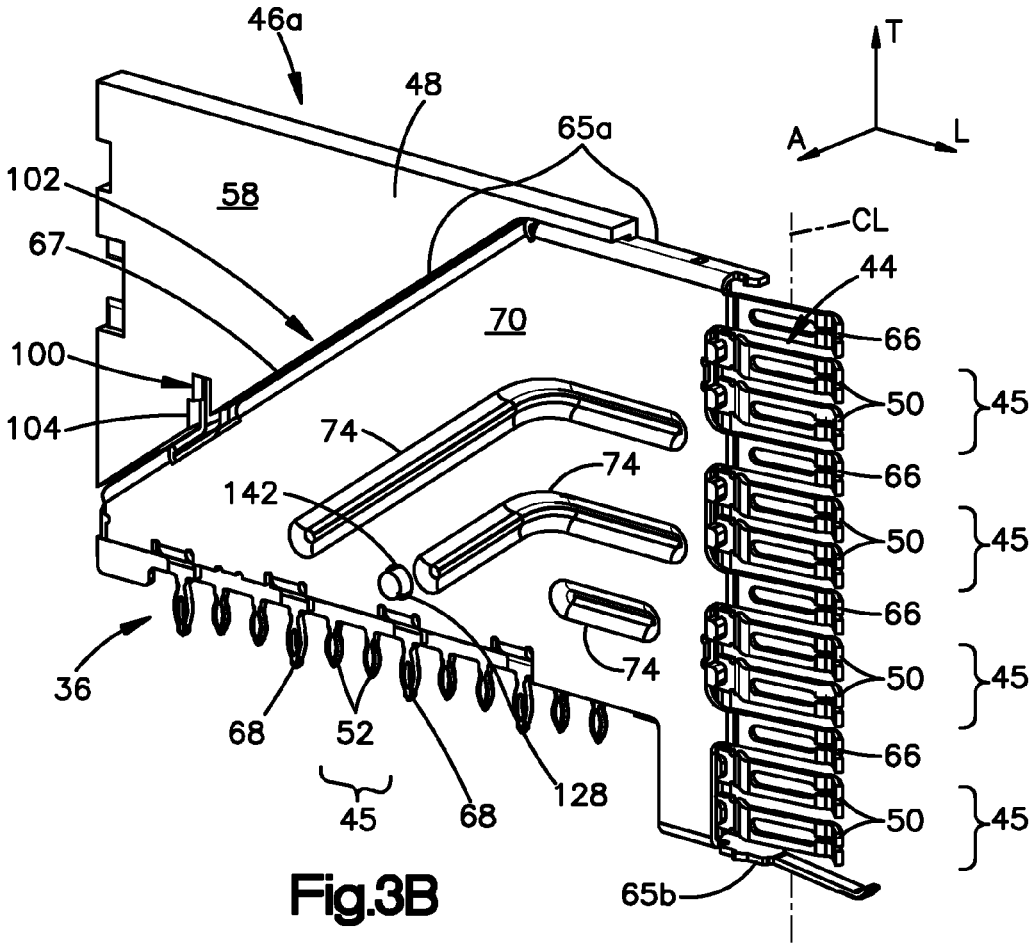
FIG. 3B is another perspective view of the leadframe assembly illustrated in FIG. 3A, showing a ground plate and a plurality of electrical signal contacts carried by a leadframe housing.
Figure 3C:
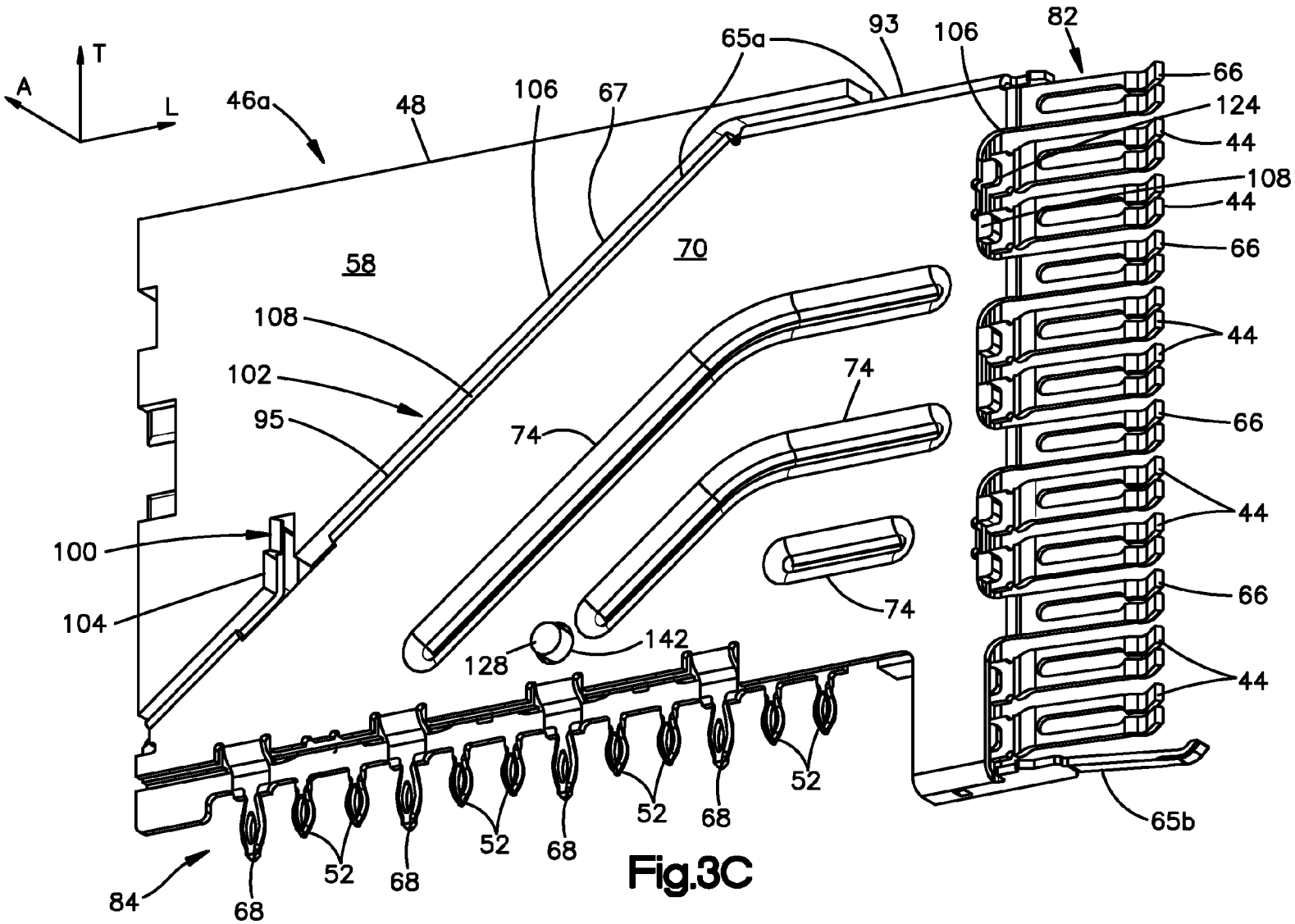
FIG. 3C is another perspective view of the leadframe assembly illustrated in FIG. 3A, showing a ground plate and a plurality of electrical signal contacts.
Figure 3D:
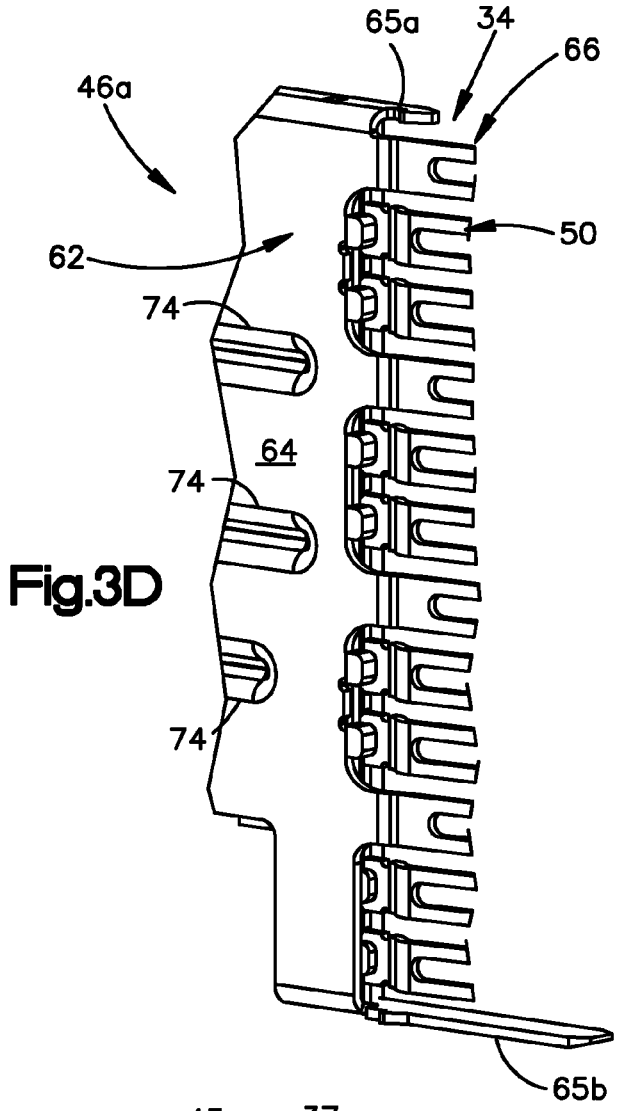
FIG. 3D is an enlarged perspective view of a portion of the mating end of the leadframe assembly illustrated in FIG. 3B.
Figure 3E:
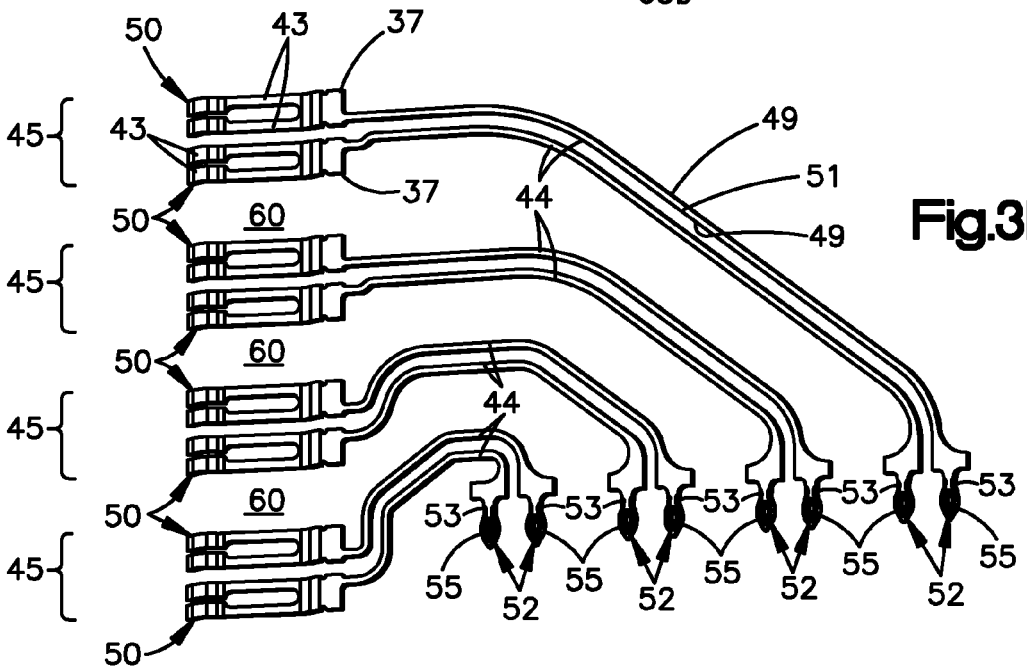
FIG. 3E is a perspective view of the electrical signal contacts of the leadframe assembly illustrated in FIG. 3A, arranged as supported by the leadframe housing.
Figure 4A:
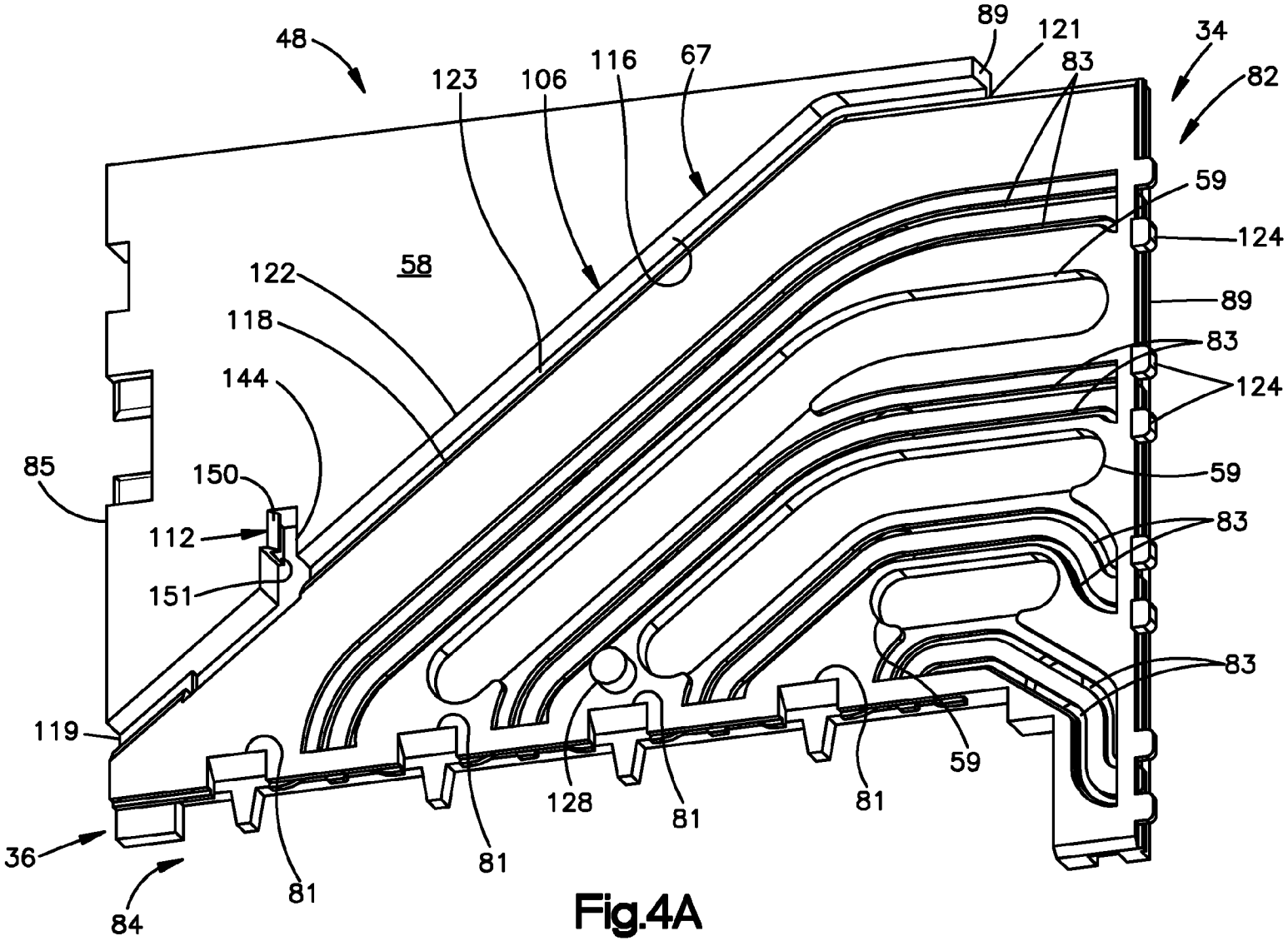
FIG. 4A is a perspective view of the leadframe housing illustrated in FIG. 3B.
Figure 4C:
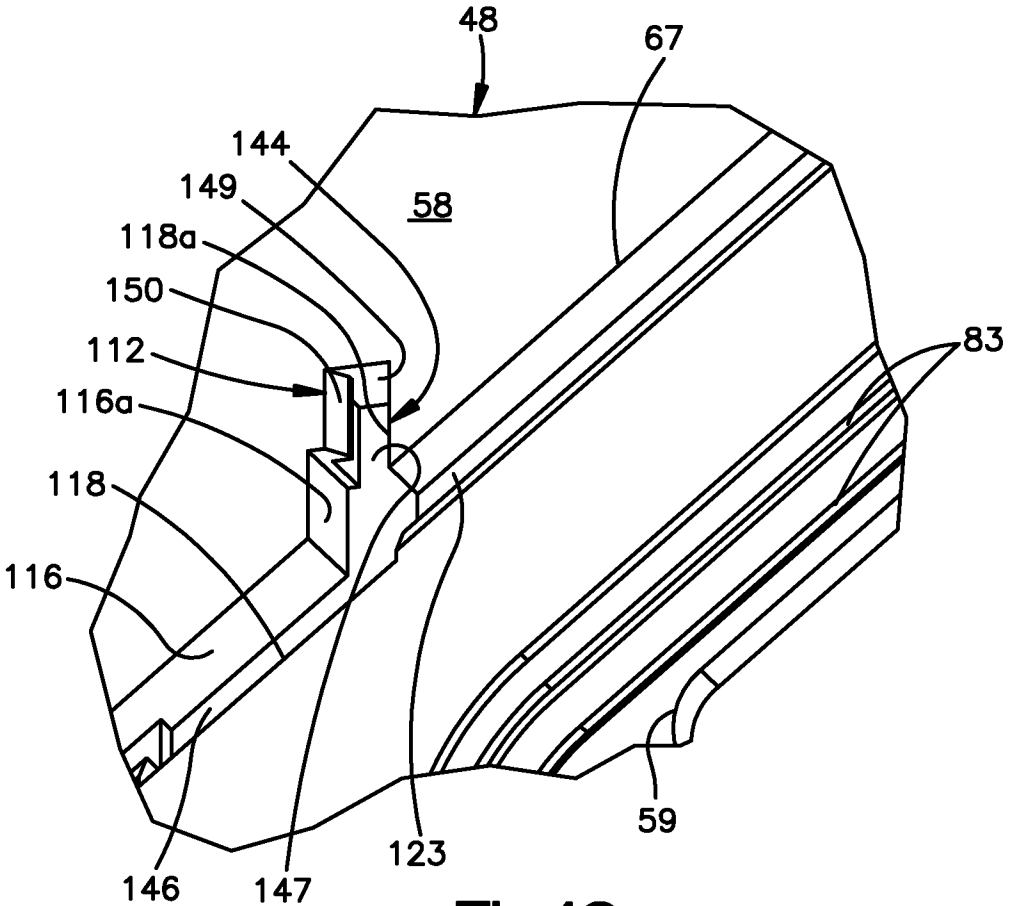
FIG. 4C is an enlarged perspective view of another portion of the leadframe housing illustrated in FIG. 4A.
Figure 4B:
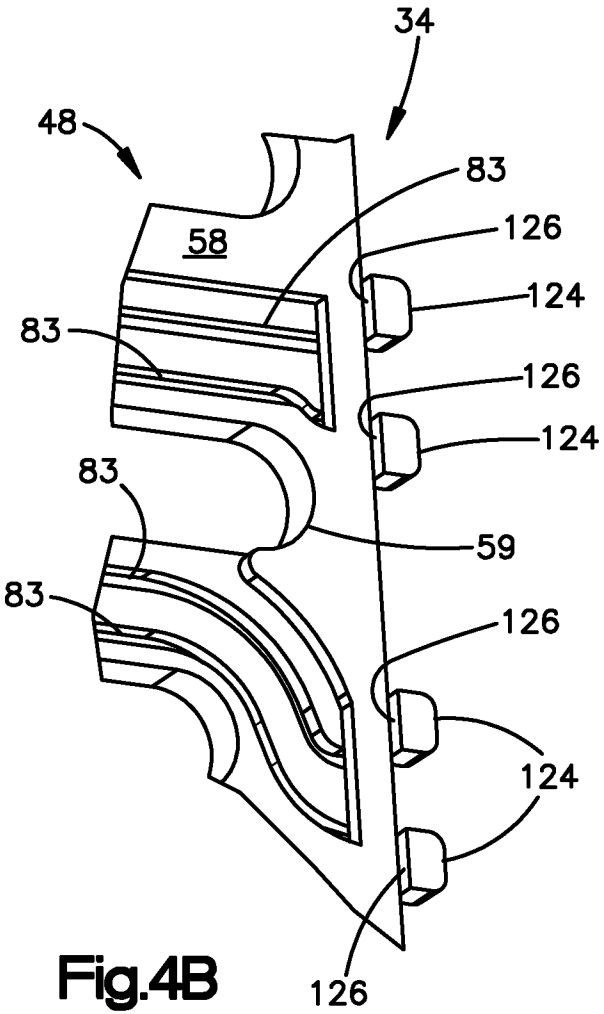
FIG. 4B is an enlarged perspective view of a portion of the leadframe housing illustrated in FIG. 4A.

Referring also to FIGS. 4A-C, the leadframe assembly 46 defines a plurality of pockets 81 that extend laterally into the outer surface 58 of the leadframe housing 48 proximate to the mounting interface 36. The pockets 81 are configured to receive the corresponding necks 61 of the ground plate 62, such that the mounting terminals 69 extend down from the leadframe housing 48. The leadframe assembly 46 further defines a plurality of channels 83 that extend through the leadframe housing 48 that retain the electrical signal contacts 44 once the electrical signal contacts 44 are overmolded or otherwise retained by the leadframe housing 48. The leadframe assembly 46 further defines at least one groove such as a plurality of grooves 59 that extend laterally into the outer surface 58 of the leadframe housing 48, and can further extend through the leadframe housing 48 as illustrated. The grooves 59 are disposed at a location between adjacent pairs of channels 83 that receive electrical signal contacts 44 corresponding to differential signal pairs 45. Referring again to FIGS. 3A-3D, because the plate body 64 is conductive, the mating ends 66 and the mounting terminals 69 are in electrical communication with each other. Furthermore, the plate 62 can provide a shield for the electrical signal contacts 44.

Referring now also to FIGS. 5A-5B, the ground plate body 64 defines a first outer surface 72 and a second outer surface 70 that is laterally opposed with respect to the first outer surface 72. The second outer surface 70 can be flush with, can protrude past, or can be inwardly recessed with respect to the corresponding outer surface 58 of the leadframe housing 48. Accordingly, the dimensions of the electrical connector 24 can remain unchanged with respect to electrical connectors whose leadframe assemblies carry discrete ground contacts, for instance as described in U.S. Pat. No. 7,497,736, the disclosure of which is hereby incorporated by reference as if set forth in its entirety herein. The first outer surface 72 faces the electrical signal contacts 44 of the leadframe assembly 46. The ground plate 62 can include an engagement member, such as a first rail 65*a* that fits into a slot 67 (FIG. 3B) that extends laterally into the outer surface 58 of the leadframe housing 48. The first rail 65*a* can partially define the outer perimeter of the ground plate 62, and can define an angled wall 95 that extends obliquely rearward from an upper horizontal wall 93. The upper horizontal wall 93 can fit over the leadframe housing 48 so as to capture the leadframe housing 48. The ground plate can further include a second rail 65*b* that that also fits over the leadframe housing 48 so as to capture the leadframe housing 48 and the ground plate 62.

The ground plate 62 can be electrically conductive, and thus configured to reflect electromagnetic energy produced by the signal contacts 44 during use, though it should be appreciated that the ground plate 62 could alternatively be configured to absorb electromagnetic energy. For instance the ground plate 62 can be made from one or more ECCOSORB® absorber products, commercially available from Emerson & Cuming, located in Randolph, Mass. The ground plate 62 can alternatively be made from one or more SRC PolyIron® absorber products, commercially available from SRC Cables, Inc, located in Santa Rosa, Ca. Furthermore, because the ground plates 62 are disposed between the signal contacts 44 of adjacent leadframe assemblies 46, the ground plates 62 can provide a shield between differential signal pairs 45 of adjacent columns CL that reduces cross-talk between the signal contacts 44 of adjacent leadframe assemblies 46.

The mating ends 66 of the ground plate 62 define ground mating ends, and are aligned along the transverse direction T, and are further aligned with the mating ends 50 of the signal contacts 44 along the transverse direction T. The mating ends 66 of the ground plate 62 can be longitudinally outwardly offset with respect to the mating ends 50 of the signal contacts 44. The mounting ends 68 are aligned along the longitudinal direction L, and are aligned with the mounting ends 52 along the longitudinal direction L. The mating ends 66 are positioned adjacent and/or between the pairs 45 of the mating ends 50 of the electrical signal contacts 44, and the mounting ends 68 are positioned adjacent and/or between pairs of mounting ends 52. Thus, the mating interface 34 of the electrical connector 24 includes both the mating ends 50 of the electrical signal contacts 44 and the mating ends 66 of the ground plate 62, and the mounting interface 36 of the electrical connector 24 includes both the mounting ends 52 of the electrical signal contacts 44 and the mounting ends 66 of the ground plate 62.

In accordance with the illustrated embodiment, when the ground plate 62 is attached to the leadframe housing 48, the mating ends 66 are disposed between a pair of mating ends 50 of adjacent electrical signal contacts 44. The mating ends 66 can thus be are thus disposed in the gap 60 between the mating ends 50 of adjacent differential signal pairs 45, such that the mating ends 50 and 66 are equidistantly spaced along the mating interface 34 of the electrical connector 24. Likewise, the mounting ends 68 of the ground plate 62 are disposed in the gap 60 that extends between them mounting ends 52 of adjacent signal pairs 45, such that the mounting ends 68 and 52 are equidistantly spaced along the mounting interface 36 of the electrical connector 24.

The first plurality of leadframe assemblies 46*a* can be constructed identically, and configured such that when the ground plate 62 is attached to the leadframe housing 48, the mating interface 34 of at least one up to all of the leadframe assemblies 46*a* are arranged in a first pattern of mating ends 50 and 66. In accordance with the illustrated embodiment, the first contact arrangement is a repeating G-S-S pattern, whereby "G" identifies the mating end 66 the ground plate 62, and "S" identifies the mating end 50 of an electrical signal contact 44, and the two adjacent "S"s in the repeating G-S-S can identify a differential signal pair 45. Because the mating ends 66 and 50 are arranged in a repeating G-S-S pattern from the top of the mating interface 34 in a downward direction toward the mounting interface 36 along the respective column CL, the leadframe assembly 46*a* and corresponding mating ends 50 and 66 can be said to define a repeating G-S-S pattern. The mounting ends 52 and 68 are therefore likewise arranged in the repeating G-S-S pattern from the rear end of the leadframe assembly 46*a* in a longitudinal direction toward the front end, or mating interface 34, of the leadframe assembly 46*a*

As described in U.S. patent application Ser. No. 12/908,344, the second leadframe assemblies 46*b* can be constructed identically, and configured such that when the ground plate 62 is attached to the leadframe housing 48, the mating interface 34 of at least one up to all of the leadframe assemblies 46*b* is arranged in a second pattern of mating ends 50 and 66. In accordance with the illustrated embodiment, the second contact arrangement is a repeating S-S-G pattern, whereby "G" identifies the mating end 66 the ground plate 62, and "S" identifies the mating end 50 of an electrical signal contact 44, and the two adjacent "S"s in the repeating S-S-G pattern can identify a differential signal pair 45. Because the mating ends 66 and 50 are arranged in a repeating S-S-G pattern from the top of the mating interface 34 in a downward direction toward the mounting interface 36 along the respective column CL, the leadframe assembly 46*a* and corresponding mating ends 50 and 66 can be said to define a repeating S-S-G pattern. The mounting ends 52 and 68 are therefore likewise arranged in the repeating S-S-G pattern from the rear end of the leadframe assembly 46*b* in a longitudinal direction toward the front end, or mating interface 34, of the leadframe assembly 46*b* It should thus be appreciated that the first and second patterns can define any pattern of ground and signal contacts (e.g., mating/mounting ends) as desired, and can further define the same pattern such that all Leadframe assemblies 46 are identically constructed.

Referring now to FIGS. 3A-D and 5A-B, the ground plate 62 can include at least one rib such as a plurality of ribs 78 that are formed (e.g., stamped) into the ground plate body 64 that extend into the grooves 59 disposed in the leadframe housing 48 between adjacent differential signal pairs 45 (see FIG. 3A). Thus, the ribs 74 are disposed between electrical signal contacts 44, for instance between adjacent differential signal pairs 45, such that a portion of the embossments 74 are planar with the electrical signal contacts 44. Thus, the ribs 74 can replace discrete ground contacts that would be supported along with the electrical signal contacts 44 in the leadframe housing 48.

The ribs 74 can be constructed as described in U.S. patent application Ser. Nos. 12/722,797 and 12/908,344 filed Oct. 20, 2010, 2009, the disclosure of each of which is hereby incorporated by reference as if set forth in its entirety herein. In accordance with the illustrated embodiment, each rib 74 is stamped or embossed into the ground plate body 64, and is thus integral with the ground plate body 64. Thus, the ribs 74 can further be referred to as embossments 78. As illustrated, each rib 74 defines a first surface 75 that defines a projection 76 that extends laterally inwardly (e.g., into the leadframe housing 48 of the leadframe assembly 46) from the outer surface 72, and an opposed second surface 77 that defines a corresponding embossment 78 or recessed surface that extends into the outer surface 70 of the ground plate body 64. Otherwise stated, the ground plate body 64 includes a plurality of projections 76 projecting laterally from the outer surface 72, and further includes a plurality of embossments 78, corresponding to the plurality of projections 76, recessed in the outer surface 70. The projections 76 can extend inward to a depth so as to be aligned with the electrical signal contacts 44 that are carried by the leadframe housing 48. The ribs 74 are positioned so as to be disposed equidistantly between adjacent differential signal pairs 45 inside the leadframe housing. The ribs 74 define respective enclosed outer perimeters 80 that are spaced from each other along the ground plate body 64. Thus, the ribs 74 are fully contained in the plate body 64.

The ground plate 62 can be retained by the leadframe housing 48 at a position such that the mating ends 66 of the ground plate 62 are be disposed between the mating ends 50 of adjacent differential signal pairs 45. The ground plates 62 can be inserted into the leadframe housing 48, overmolded by the leadframe housing 48, or otherwise carried or retained by the leadframe housing 48 such that the dimensions of the leadframe assembly 48 are substantially equal to those of conventional leadframe assemblies that contain discrete signal contacts and ground contacts overmolded by or otherwise coupled to a leadframe housing. The ground plate body 64 spans across a portion of a plurality up to all of the differential signal pairs 45 that is disposed in the leadframe housing 48.

The leadframe assemblies 46 do not include discrete ground contacts, but rather includes the ground plate 62 that provides a low-impedance common path to intercept and dissipate stray electro-magnetic energy that otherwise would have been a source for cross talk between the electrical signal contacts 44 of adjacent leadframe assemblies 48. The ground plate 48 can be configured to reflect electromagnetic energy produced by the signal contacts 44 during use, though it should be appreciated that the plate could alternatively be configured to absorb electromagnetic energy. For instance, the ground plates 62 can be made of any lossy material, conductive or nonconductive.

The ground plate 62 can further include a ground coupling bar connected between adjacent ground terminals at the mating interface, thereby increasing the resonance frequency of the connector, as described in U.S. patent application Ser. No. 12/908,344 filed Oct. 20, 2010, the disclosure of which is hereby incorporated by reference as if set forth in its entirety herein. For instance, as illustrated in FIG. 3F, each ground plate 62 can include at least one ground coupling beam 88 that is connected between at least a select pair of mating ends 66. Thus, the ground coupling beam 88 can be connected between a first and second mating end 66 that is each disposed between adjacent electrical signal contacts 44, and in particular between adjacent differential signal pairs 45. Furthermore, a pair of electrical signal contacts 44, such as a differential signal pair 45, is disposed between the first and second mating ends 66 that are connected by the ground coupling beam 88. In accordance with the illustrated embodiment, the leadframe assembly 46 includes a plurality of ground coupling beams 82. Each ground coupling beam 88 is connected between adjacent mating ends 66, and is conductive so as to place the adjacent mating ends in electrical communication through the ground coupling beam 88. In particular, each ground coupling beam 88 is connected between one but not both of the fingers 63*a* and 63*b* of a given mating end 66. For instance, each ground coupling beam 88 is connected to the lower finger 63*b* of a first or upper mating end 66 and the upper finger 63*a* of a second or lower mating end 66. It should be appreciated, however that one or more of the ground beams 82 can be connected between the fingers 63*a* and 63*b* of adjacent mating ends 66, and can further be connected between the fingers 63*a* and 63*b* of a given mating end 66 as desired. Thus, at least one of the ground beams 82 can be connected to as many mating ends 66 as desired, up to all of the mating ends 66 of the ground plate 62. The ground coupling beams 82 can be integral with or discretely connected to the mating ends 66 as desired.

Figure 3F:
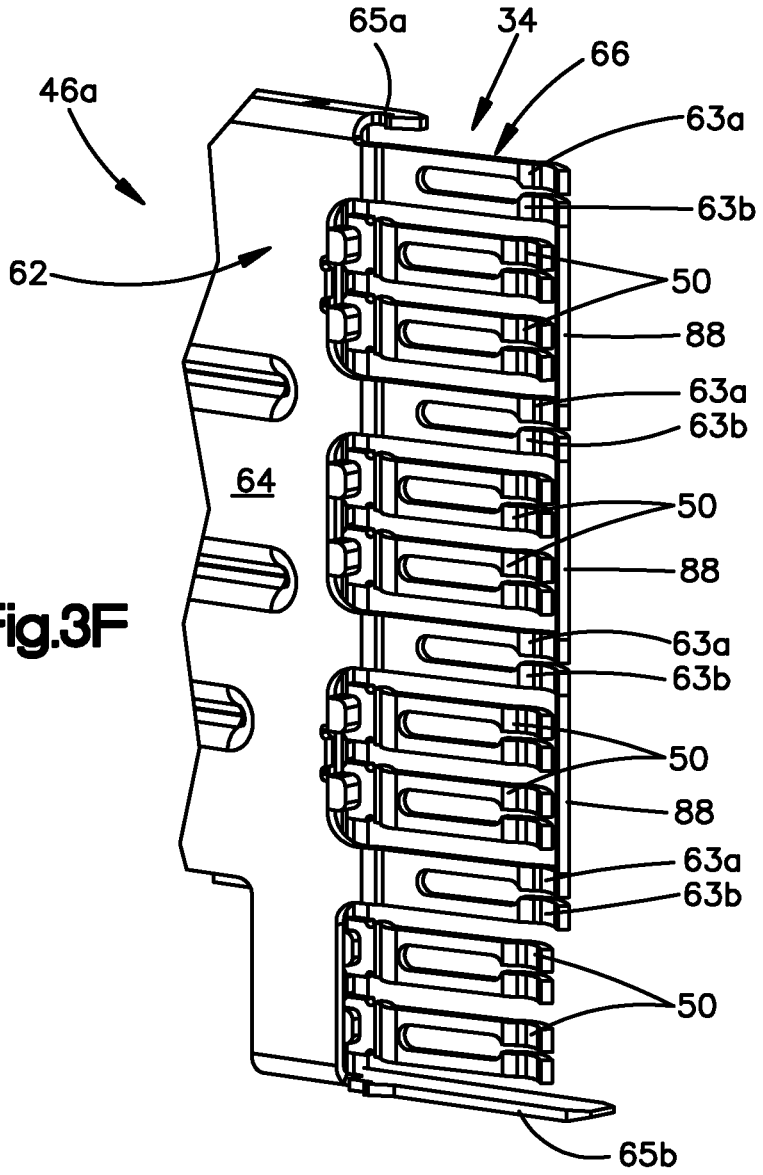
FIG. 3F is an enlarged perspective view of the mating end of the leadframe assembly illustrated in FIG. 3B including a ground coupling bar in accordance with an alternative embodiment.

Referring now to FIGS. 3B-C, the leadframe assembly 46 includes an attachment system 100 that aligns and attaches the ground plate 62 to the leadframe housing 48. The attachment system 100 includes an alignment assembly 102 that aligns the leadframe housing 48 and the ground plate 62, and an attachment assembly 104 that resists separation of the ground plate 62 from the leadframe housing 48. The alignment assembly 102 includes datum locations 106 of the leadframe housing 48 that engage corresponding datum locations 108 of the ground plate 62 so as to provide a brace that limits or prevents relative movement between the ground plate body 64 and the leadframe housing 48 along a direction substantially perpendicular to the mating direction A of the ground plate body 64 and the leadframe housing 48, thereby maintaining alignment between the ground plate 62 and the leadframe housing 48 during and after attachment of the ground plate 62 to the leadframe housing 48. The attachment assembly 104 includes a first engagement member and a second engagement member. For instance, the leadframe housing 48 includes the first engagement member in the form of a catch 112 carried by the first outer surface 58, and the ground plate 62 includes the second engagement member in the form of a latch 109 carried by the ground plate body 64 that mates with the first engagement member to lock the ground plate 62 to the leadframe housing 48 so as to resist or prevent separation of the ground plate 62 from the leadframe housing 48.

Referring now to FIGS. 3A-4C, the datum locations 106 of the leadframe housing 48 will now be described. In particular, the outer surface 58 of the leadframe housing 48 faces and can abut the complementary outer surface 72 of the ground plate body 64 when the ground plate 62 is attached to the leadframe housing 48. Thus, the outer surfaces 58 and 72 can be referred to as complementary first and second respective outer engagement surfaces. The outer surfaces 58 and 72 are substantially planar in the longitudinal-transverse plane as illustrated. The opposed outer surface 56 of the leadframe housing 48 faces away from the ground plate 62 when the ground plate 62 is attached to the leadframe housing 48, and the opposed outer surface 70 of the ground plate 62 faces away from the leadframe housing 48 when the ground plate 62 is attached to the leadframe housing 48. The datum location 106 further includes the slot 67 that projects into the outer surface 58 of the leadframe housing 48, and extends to and between a first, or front, terminal end 121 and a second, or rear, terminal end 119. The first terminal end 121 is disposed at the longitudinally front end 89 of the leadframe housing 48 disposed proximate to the mating end 82 of the leadframe housing 48, and the second terminal end 119 is disposed at a longitudinally opposed rear end 85 of the leadframe housing 48.

The slot 67 is defined by a pair of opposing spaced inner and outer laterally extending first and second side walls 116 and 118, respectively, and a base 123 connected between the side walls 116 and 118 at a location inwardly spaced from the outer surface 56. The slot 67 includes an upper longitudinal portion 120, and an angled portion 122 that is configured to receive the upper longitudinal wall 93 and the angled wall 95, respectively, of the upper rail 65*a* when the ground plate 62 is attached to the leadframe housing 48. The slot 67 extends into, but not through, the leadframe housing 48 at a location spaced outwardly from the outermost electrical signal contact 44. Alternatively, the slot 67 can extend into and through the leadframe housing 48. In embodiments where the entire slot 67 extends through the leadframe housing 48, the slot 67 can terminates inward with respect to one or both of the front end 89 and the rear end 85 so as to maintain the structural integrity of the leadframe housing 48. Alternatively still, the slot 67 can extend continuously between its terminal ends 119 and 121 as illustrated, or discontinuously so as to define slot segments. Alternatively or additionally still, the slot 67 can define variable lateral depths along its length.

The leadframe assembly 46 further includes at least one alignment tab 124, and a plurality of alignment tabs 124 as illustrated, that extend longitudinally forward from the front end 89 of the leadframe housing 48. The alignment tabs 124 can further projecting laterally out from the outer surface 58 of the leadframe housing 48 in a direction toward the ground plate 62 that is attached to the leadframe housing 48. The alignment tabs 124 define corresponding respective rear abutment surfaces 126. The abutment surfaces 126, and thus the alignment tabs 124, can extend from the outer surface 58 any distance as desired, such as a distance that is substantially equal to or slightly less than the lateral thickness of the ground plate body 64, or alternatively greater than the lateral thickness of the ground plate body 64. Alternatively or additionally, the leadframe assembly 46 can include one or more heat stake posts 128 that project laterally outward from the outer surface 58 of the leadframe housing 48 in a direction toward the ground plate 62 that is attached to the leadframe housing 48. The heat stake post 128 is illustrated as extending from the outer surface 58 a distance that is substantially equal to or greater than the lateral thickness of the ground plate body 64, or alternatively less than the lateral thickness of the ground plate body 64.

Thus, the alignment assembly 102 can include at least one datum location 106 of the leadframe housing 48 that, in turn, includes one or more up to all of the slot 67, the alignment tabs 124, and the heat stake post 128 that facilitates alignment of the ground plate 62 and the leadframe housing 48 during attachment of the ground plate 62 to the leadframe housing 48, as will be described in more detail below.

Referring now to FIGS. 5A-B, the datum locations 108 of the ground plate 62 will now be described. In particular, the ground plate 62 includes the first rail 65*a* that, in turn, includes the upper longitudinal wall 93 and the angled wall 95 as described above. The first rail 65*a* can define a lateral thickness slightly less than or equal to the depth of the slot 67 of the leadframe housing 48. The first rail 65*a* is aligned with the slot 67, and is positioned to be disposed in the slot 67 when the ground plate 62 is attached to the leadframe housing 48. The first rail 65*a* defines an outer side wall 97 configured to abut the side wall 116 when the first rail 65*a* is disposed in the slot 67. It should be appreciated that the first rail 65*a* defines an alignment guide that engages (e.g., is received in) the slot 67 of the leadframe housing 48 (and the outer side wall 97 abuts the side wall 116) so as to align the ground plate 62 and the leadframe housing 48 during and after attachment of the ground plate 62 to the leadframe housing 48. Thus, the first rail 65*a* and the slot 67 can be referred to as first and second complementary alignment members that present complementary engagement walls illustrated as the side walls 97 and 116. The angled wall 95 includes a rear portion 95*a* and a front portion 95*b* that is separated from the rear portion 95*a* by a gap 137. A longitudinally front portion of the upper longitudinal wall 93 can define an alignment notch 115 configured to abut the front end 89 of the leadframe housing 48.

With continuing reference to FIGS. 4A-B, the ground plate 62 further includes one or more alignment seats 138 disposed between adjacent mating ends 66 of the ground plate 62. Each of the alignment seats 138 is positioned to abut a corresponding one or more of the abutment surfaces 126 of the alignment tabs 124. The ground plate 62 can further include an opening 142 that extends laterally into the outer surface 72 of the ground plate body 64, and can further extend laterally through the ground plate body 64. The opening 142 is sized substantially equal to or slightly greater than the heat stake post 128 of the leadframe assembly 46, such that the heat stake post 128 can be press-fit or otherwise inserted into the opening 142.

Thus, the alignment assembly 102 can include at least one datum location 108 of the ground plate 62 that, in turn, includes one or more up to all of the first rail 65*a*, the alignment seats 138, and the opening 142 that facilitates alignment of the ground plate 62 and the leadframe housing 48 during attachment of the ground plate 62 to the leadframe housing 48. For instance, as the ground plate 62 is attached to the leadframe housing 48, the ground plate 62 can be captured between a first alignment interface defined by the side wall 116 of the slot 67 and the outer side wall 97 of the ground plate 62, and a second alignment interface defined by the alignment tabs 124 and the alignment seats 138.

The attachment assembly 104 will now be described with initial reference to FIGS. 4A and 4C. In particular, a portion of the slot 67 defines a receiving aperture 144 that extends through the leadframe housing 48 to a depth greater than that of the surrounding slot 67. In accordance with the illustrated embodiment, the receiving aperture 144 extends laterally through the leadframe housing 48. The receiving aperture 144 defines the shape of a dogleg, including a first or proximal portion 146 that can be inline, or substantially parallel, with the slot 67, and a second or distal portion 147 that extends at an angle oblique with respect to the proximal portion 146, and thus also with respect to the slot 67. The opposed side walls 116 and 118 define side walls of the receiving aperture 114 at the first portion 146, and further define respective side walls 116*a* and 118*a* of the distal portion 147. Thus, the receiving aperture 144 is defined by a pair of opposing side walls 116/116*a* and 118/118*a*, and an end wall 149 that defines a terminal end of the distal portion 147.

Figure 8B:
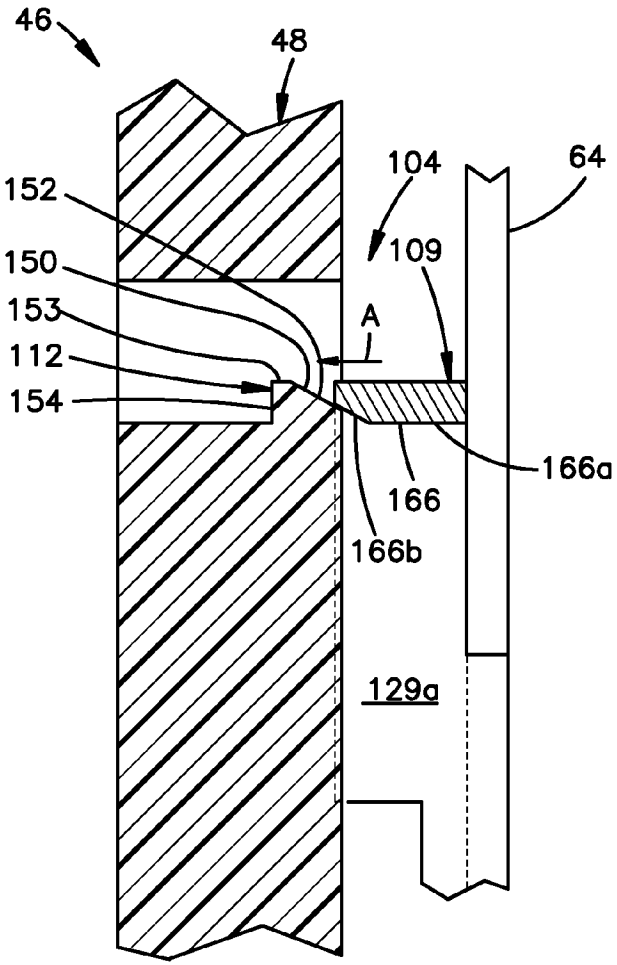
FIG. 8B is a top cross-sectional view of a portion of the leadframe assembly as illustrated in FIG. 7B.
Figure 8A:
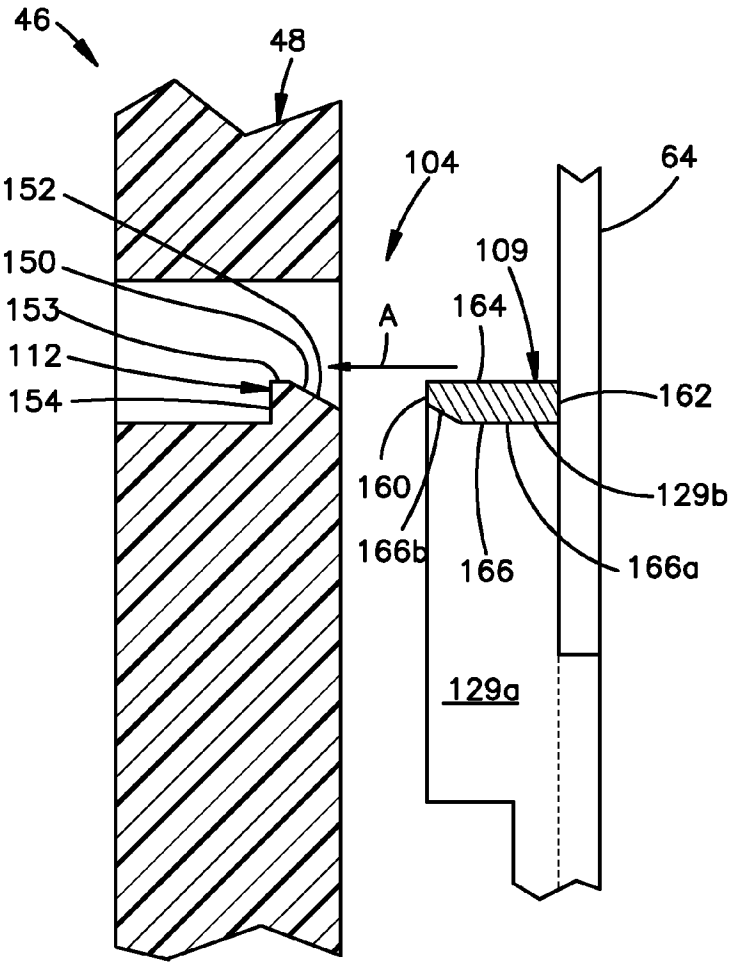
FIG. 8A is a top cross-sectional view of a portion of the leadframe assembly as illustrated in FIG. 7A.

Referring also to FIG. 8A, the attachment assembly 104 further includes a first engagement member of the leadframe housing 48, such as the catch 112 that can include a ramp 150 that extends from one of the side walls 116*a* and 118*a* of the distal portion 147. In accordance with the illustrated embodiment, the ramp 150 is disposed in the distal portion 147, and extends from the first side wall 116*a*, though it should be appreciated that the attachment assembly 104 can include one or more ramps carried by at least one of the side walls 116, 116*a*, 118, 118*a* and the end wall 149. The ramp 150 defines a cam surface 152 that is angled longitudinally forward into the distal portion leadframe housing 48 along a laterally direction from the outer surface 58 toward the opposed outer surface 56. The ramp 150 further defines a catch surface 154 that extends longitudinally rearward from a substantially planar lateral surface 153 that extends rearward from the cam surface 152 with respect to a direction of travel of the latch 109 as the latch 109 mates with the catch 112. The catch surface 154 is illustrated as a rear wall that extends from a rear edge of the cam surface 152 along a direction oblique to the cam surface 152. For instance, as illustrated, the catch surface 154 extends in a rearward direction (e.g., a direction having a longitudinally rearward directional component toward the rear end 85 of the leadframe housing 48).

The attachment assembly 104 will now be further described with reference to FIGS. 5A-B. In particular, the ground plate 62 includes a latch 109 having a latch arm 111. The latch arm 111 can be shaped as a dogleg, and includes a first or proximal portion 129*a* and a second or distal portion 129*b* that extends obliquely to the proximal portion 129*a*. The proximal portion 129*a* is attached to the forward end of the rear portion 95*a* of the angled wall 95 and can be oriented inline, or substantially parallel, with the angled wall 95. The proximal portion 129*a* can further extend into the gap 137. The proximal portion 129*a* can further project laterally from the first rail 65*a* along a lateral direction from the second outer surface 70 toward the second outer surface 72. The distal portion 129*b* is angled with respect to the proximal portion 129*a* and projects away from the angled wall 95. For instance, the distal portion 129*b* can be elongate substantially in the transverse direction T, while the proximal portion 129*a* can be elongate along a direction that is oblique to the transverse direction T.

Referring also to FIGS. 7A-8D, the distal portion 129*b* defines opposed front and rear surfaces 160 and 162, respectively, and opposed top and bottom surfaces 164 and 166, respectively, connected between the front and rear surfaces 160 and 162. The bottom surface 166 can define a substantially laterally planar portion 166*a* and a beveled engagement end 166*b* that extends substantially parallel to the cam surface 152 when the latch 109 and the catch 112 are operably aligned. The front surface 160 is spaced laterally from the outer surface 72 of the ground plate body 64 by a distance that is slightly greater than the lateral distance that the catch surface 154 of the ramp 150 is spaced from the outer surface 58 of the leadframe housing 48.

The attachment of the ground plate 62 and the leadframe housing 48 will now be described with initial reference to FIGS. 7A and 8A. As illustrated, the ground plate 62 is aligned with the leadframe housing 48 by placing the rail 65*a* of the ground plate 62 into the slot 67, such that the rear walls 126 of the alignment tabs 124 are seated against the corresponding alignment seats 138, and the necks 61 of the mounting portions 68 of the ground plate 62 are disposed in the corresponding pockets 81 of the leadframe housing 48, and the alignment notch 115 abuts the front end 89 of the leadframe housing 48 (FIG. 3A). Thus, the engaging components of the alignment assembly 102 position the leadframe assembly 46 in an aligned configuration such that the latch 109 of the ground plate 62 is operably aligned with the catch 112 of the leadframe housing such that latch 109 interlocks with the catch 112 so as to attach and lock the ground plate 62 to the leadframe housing 48.

Figure 7B:
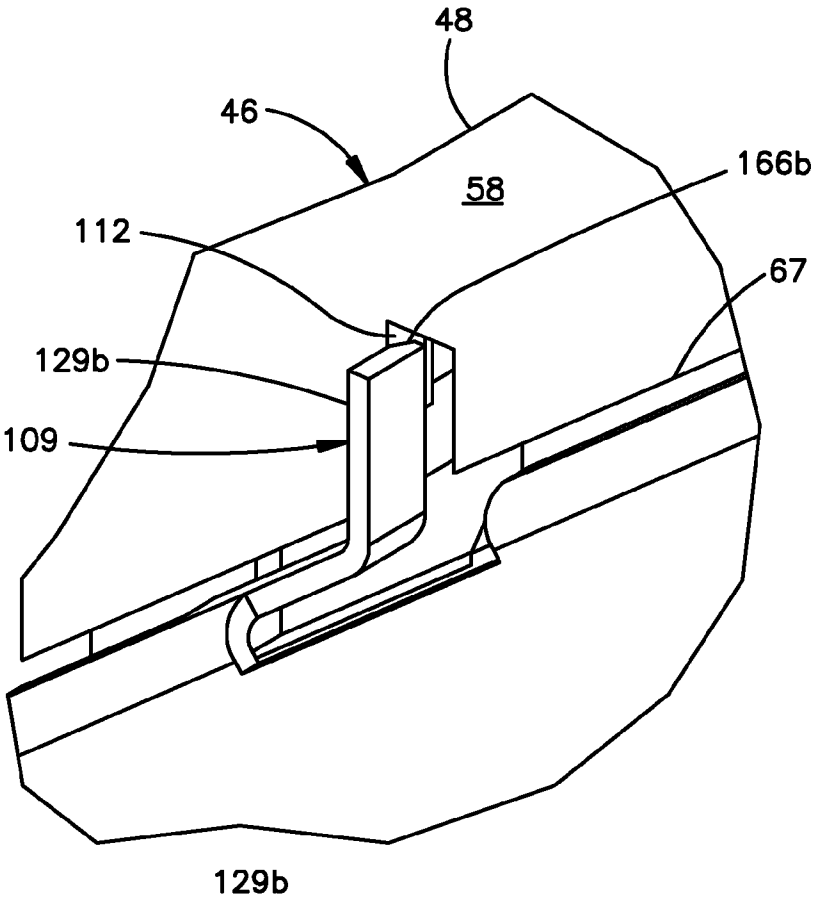
FIG. 7B is an enlarged partial perspective view similar to FIG. 7A, but showing the attachment assembly in a first attaching state.
Figure 7A:
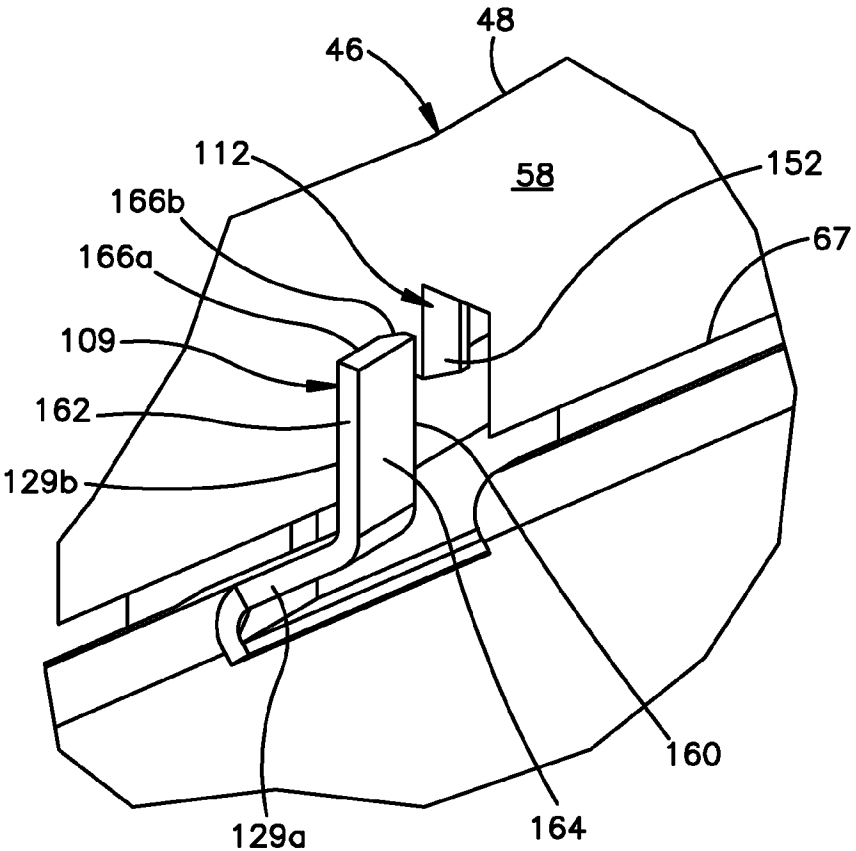
FIG. 7A is an enlarged partial perspective view of a portion of the leadframe assembly showing the attachment assembly in an initial state.

In particular, as shown in FIGS. 7A and 8A, the latch arm 111 is aligned with the dogleg aperture 144, such that the distal portion 129*b* of the latch arm 111 is laterally offset but aligned with the ramp 150 in an initial state. As at least one or both of the outer surfaces 72 and 58 are brought laterally toward each other along the mating direction A, the beveled engagement end 166*b* of the bottom surface 166 rides along the cam surface 152 of the catch 112, as illustrated in FIGS. 7B and 8B. With continuing reference to FIGS. 7C and 8C, at least one or both of the outer surfaces 58 and 72 are continued to be brought laterally toward each other along the mating direction A, until the beveled engagement end 166*b* has ridden past the cam surface 152, and the substantially planar portion 166*a* of the bottom surface 166 rides along the substantially planar surface 153 of the ramp 150. In this regard, it should be appreciated that the bottom surface 166 defines a complementary cam surface that rides along the cam surface 152 when the latch 109 initially engages the catch 112.

Figure 9:
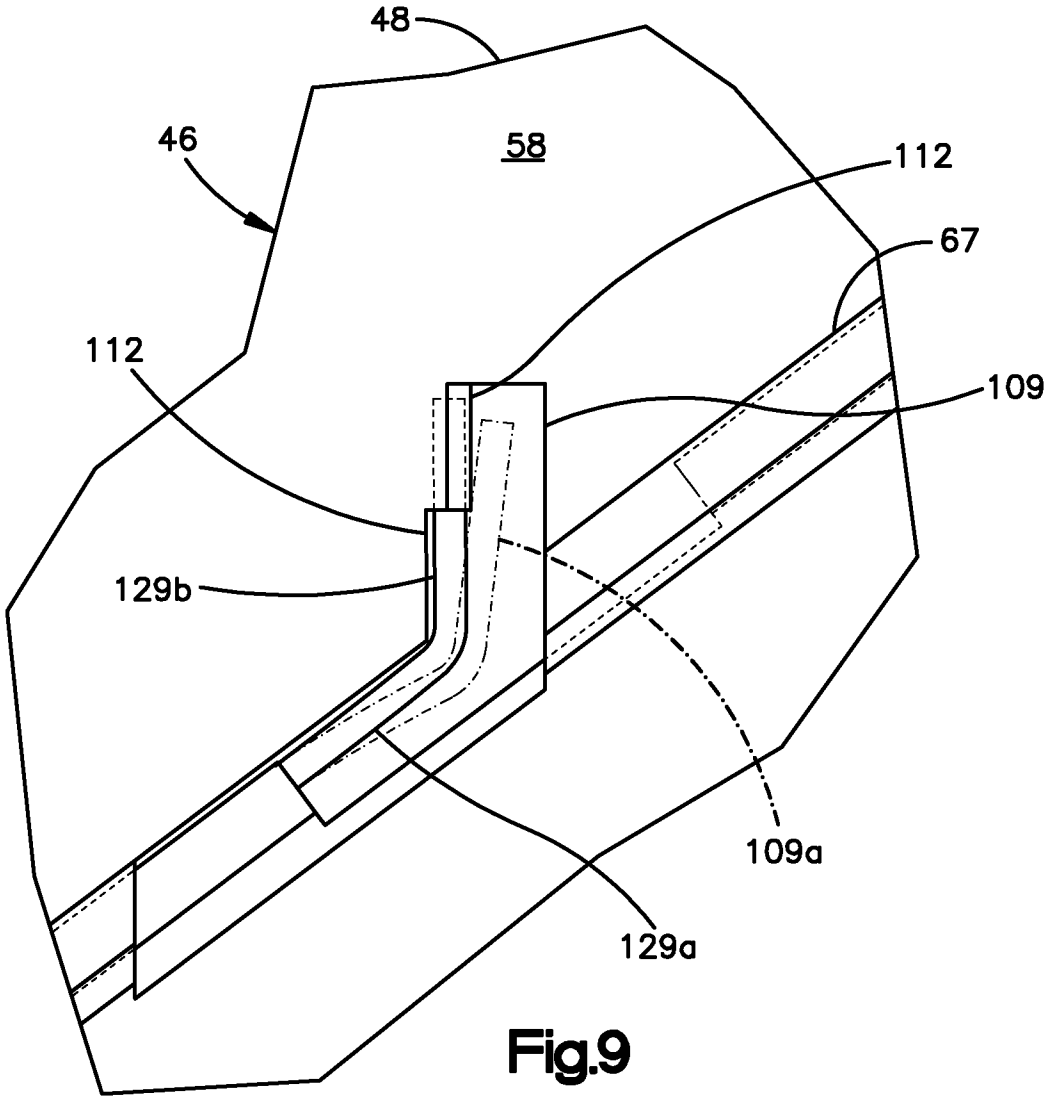
FIG. 9 is an enlarged side elevation view of the leadframe assembly 46 as illustrated in FIGS. 7D and 8D.

It should be appreciated that the latch 109 can be flexible, such that as the bottom surface 166 rides along the ramp 150, the distal portion 129*b* of the latch 109 becomes resiliently deflected in a direction indicated by Arrow B, which is substantially perpendicular to Arrow A, along a longitudinal direction having a longitudinally forward directional component toward the mating end 82 of the leadframe assembly 46 to a resiliently deflected position 109*a* (see FIG. 9). In accordance with the illustrated embodiment, the latch 109 deflects in the longitudinally forward direction, substantially parallel to the surfaces 58 and 72 of the leadframe housing 48 and the ground plate body 64, respectively.

Figure 7D:
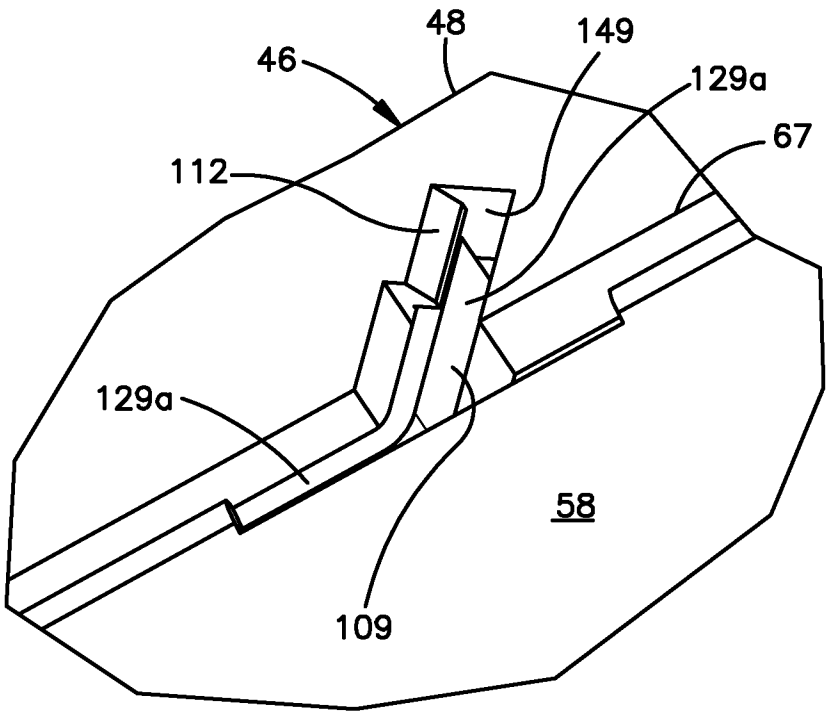
FIG. 7D is an enlarged partial perspective view similar to FIG. 7C, but showing the attachment assembly in a fully attached state.
Figure 7C:
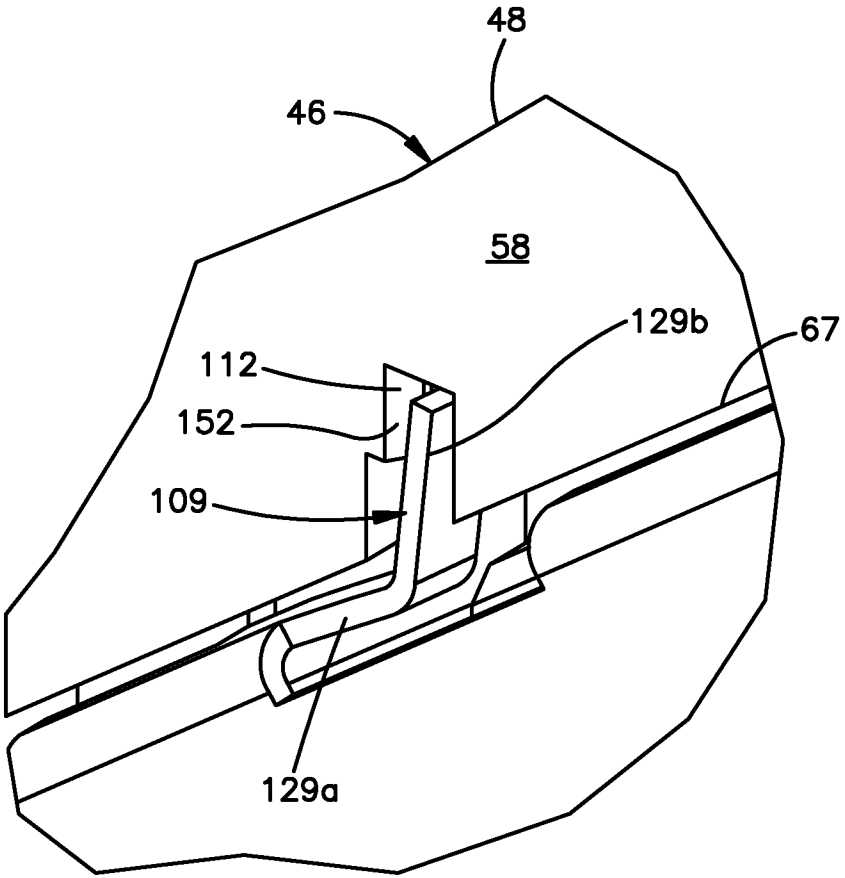
FIG. 7C is an enlarged partial perspective view similar to FIG. 7B, but showing the attachment assembly in a second attaching state.
Figure 8D:
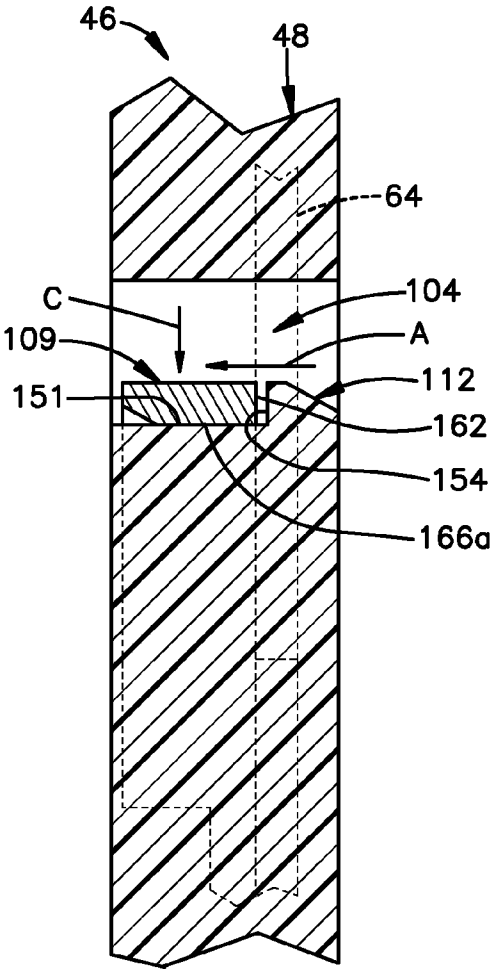
FIG. 8D is a top cross-sectional view of a portion of the leadframe assembly as illustrated in FIG. 7D.
Figure 8C:
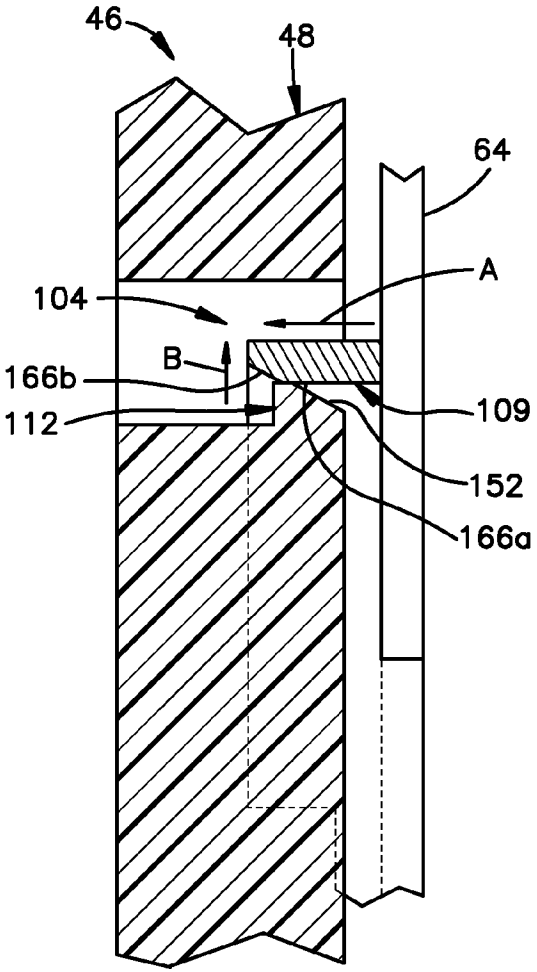
FIG. 8C is a top cross-sectional view of a portion of the leadframe assembly as illustrated in FIG. 7C.

Referring now to FIGS. 7D and 8D, the latch 109 and the catch 112 can fully mate with or engage each other such that the ground plate 62 becomes attached and locked to the leadframe housing 48. In particular, the latch 109 and the catch 112 are fully mated when the distal portion 129*b* of the latch 109 moves laterally past the cam surface 152, and the spring force of the latch arm 111 causes the distal portion 129*b* to snap, or move, in a longitudinally rearward direction indicated by arrow C opposite the direction of Arrow B until the distal portion 129*b* sits against the side wall 116*a* from which the ramp 150 extends, or against a seat 151 of the catch 112 that extends laterally out from the catch surface 154 as illustrated in FIG. 8D (see also FIG. 4A). Thus, when the ground plate 62 is attached to the leadframe housing 48, the latch 109 moves in a first direction (arrow A) substantially parallel to the outer surface 58 of the leadframe housing 48 as the latch 109 engages the ramp 150, and subsequently moves in a second direction (arrow B) substantially parallel to the outer surface 58 of the leadframe housing 48 and opposite the first direction. When the latch 109 is in the attached state, the distal portion 129*b* of the latch arm 111 is disposed behind the catch surface 154 of the ramp 150 as illustrated in FIGS. 2 and 6D, such that interference between the latch arm 111 and the catch surface 154 prevents the ground plate 62 from being separated laterally from the leadframe housing 48.

The ground plate 62 can be constructed sufficiently thin to fit between the leadframe housing 48 to which it is attached and the leadframe housing 48 of an immediately adjacent leadframe assembly 46 (and in particular between the outer surface 58 of the leadframe housing 48 to which the ground plate 62 is attached and the outer surface 56 of the adjacent leadframe housing 48) having the dimensions of a conventional electrical connector. Furthermore, the attachment system 100 can be configured as described herein such that the lateral depth of a pair of adjacent leadframe assemblies 46 is not greater than a pair of conventionally constructed leadframe assemblies that includes a plurality of discrete electrical signal contacts and electrical ground contacts that are overmolded by a leadframe housing. Accordingly, the attachment system 100 can be constructed so as to not increase the physical dimensions (e.g., lateral dimension) of an electrical connector that incorporates conventional leadframe assemblies that are devoid of ground plates, or that include ground plates without an attachment system 100 of the type described herein. Accordingly, the leadframe assembly 46 as described here in can be dimensioned the same as an otherwise identically constructed leadframe assembly 46 that includes individual electrical signal contacts and ground contacts overmolded by the leadframe housing.

It should be appreciated that the attachment assembly 104 automatically latches the ground plate 62 to the leadframe housing 48 when at least one or both of the ground plate 62 and the leadframe housing 48 is pressed against the other in an aligned configuration achieved by the alignment assembly 102. The attachment assembly 104 causes a force to be applied from the catch 112 to the latch 109 that biases the latch 109, and thus the ground plate 62 longitudinally forward toward the mating end 82 of the leadframe assembly 46. However, engagement between at least one of the engagement tabs 124 and the alignment seats 138, the upper rail 65*a* and the slot 67 (for instance the side wall 118 that defines the slot 67) prevents or limits movement of the ground plate 62 with respect to the leadframe housing 48 such that the latch 109 remains operably aligned with the catch 112 as the ground plate 62 is attached to the leadframe housing. Engagement between the side wall 116 of the slot 67 and the outer side wall 97 of the upper rail 65*a* can prevent or limit movement of the ground plate 62 relative to the leadframe housing 48 in the transverse direction. Thus, it can be said that engagement between at least one alignment member of the ground plate 48 and at least one complementary alignment member of the ground plate 62 provides a brace that limits, and can prevent, movement of the ground plate 62 with respect to the leadframe housing 48 (for instance, toward the mating end 82 of the leadframe assembly 82) such that the latch 109 remains operably aligned with the catch 112 as the ground plate 62 is attached to the leadframe housing 48, and further limits, and can prevent, movement of the ground plate 62 with respect to the leadframe housing 48 (for instance substantially parallel to the mating end 82) during and after attachment of the ground plate 62 to the leadframe housing 48.

It should be further appreciated that the attachment assembly 104 facilitates attachment of the ground plate 62 to the leadframe housing 48, such that the latch 109, and also the ground plate 62, can be devoid of apertures that extend through the ground plate body 64 between the leadframe housing 48 to which the ground plate body 64 is attached and an adjacent leadframe housing 48 of an adjacent leadframe assembly 46, for instance through the opposed outer surfaces 70 and 72 of the ground plate body 64. For instance, the latch 109, and also the ground plate 62, can be devoid of apertures that are at least partially or fully enclosed by the ground plate body 64 and extend through the ground plate body 64 between the opposed outer surfaces 70 and 72. In this regard, the leadframe assembly 46 can be provided without the heat stake post 128 and the complementary opening 142. Furthermore, the gap 137 extends through the first rail 65*a*, and not the ground plate body 64. Accordingly, the ground plate body 64 is devoid of apertures that could otherwise allow electromagnetic interference to pass through the ground plate 62 between differential signal pairs 45 of adjacent leadframe assemblies 46 that could produce cross-talk during operation of the electrical connector.

While the attachment system 100 has been described in connection with one embodiment, it should be appreciated that numerous alternative embodiments could be incorporated to facilitate alignment and attachment of the ground plate 62 and leadframe housing 48. It should be appreciated that while the first engagement member of the leadframe housing 48 is illustrated as the catch 112, the first engagement member of the leadframe housing 48 can alternatively be a latch, for instance latch 109, or any suitable engagement member, and the second engagement member of the ground plate 62 is illustrated as the latch 109, the second engagement member of the ground plate 62 can alternatively be configured as a catch, for instance latch 112, or any suitable engagement member, such that engagement of the first and second members attaches the ground plate 62 to the leadframe housing 48.

The present leadframe assembly 46 thus provides an attachment system 100 that secures an external electrical component to a leadframe housing 48. Because the leadframe housing 48 is overmolded onto the electrical signal contacts 44 prior to attachment of the external electrical component, it can be said that the external electrical component is attached to an IMLA. The external component can be provided as a ground plate, such as the ground plate 62, that improves the performance of shieldless, high density, right-angle electrical connectors having discrete ground contacts without significantly lowering impedance matching and without significantly increasing inductance. In one embodiment, the discrete ground contacts of a conventional leadframe assembly are removed in favor of ribs, such as ribs 74, formed in the ground plate 62, which provide ground terminals at the mating and mounting interfaces 34 and 36, respectively, in place of the removed ground contacts of the leadframe assembly 46. In another embodiment, the ground plate can include at least one ground coupling bar connected between adjacent ground terminals of the ground plate 62 at the mating interface 34, thereby increasing the resonance frequency of the electrical connector 24. In an alternative embodiment, the ground plate 62 can be provided as a shield that is disposed between adjacent leadframe assemblies 46 that include signal and ground contacts. As will be appreciated, the attachment system 100 can facilitate the attachment of any external component to a leadframe assembly, or other electrical contact or connector such that the external electrical component is devoid of openings that extend through the external electrical component which could adversely affect the performance of the external electrical component, and therefore of the electrical connector during operation. The attachment system can further facilitate the securement of the external electrical component to the leadframe assembly 46 without altering (e.g., increasing) the overall dimensions of the connector with respect to a connector that includes a plurality of leadframe assemblies that retains discrete ground contacts as opposed to an external plate.

It should be further appreciated that while the external plate 57 has been illustrated and herein with respect to the ground plate 62, the external plate 57 could assume any plate or component as desired. For instance, the leadframe assembly 46 can include electrical signal and ground contacts overmolded or otherwise retained by the leadframe housing 48 in the manner described in U.S. patent application Ser. No. 12/393,794, and the external plate 57 can be provided as a flat (e.g., devoid of ribs 74) or alternatively shaped plate that is attached to the leadframe housing 48 in the manner described above, and shields the electrical signal contacts 44 of adjacent leadframe assemblies 46, and does not replace the electrical ground contacts of the leadframe assemblies 46. Alternatively still, while the attachment assembly 100 includes the alignment assembly 102 and the attachment assembly 104 as described above, the attachment assembly 100 can include one or both of the alignment assembly 102 and the attachment assembly, for instance if it is desired to align the external plate 57 and the leadframe housing 48 prior to connecting the external plate 57 to the leadframe assembly 48 using a different attachment assembly, or if it is desired to attach the external plate 62 and the leadframe housing 48 that have already been aligned.

It should be noted that the illustrations and discussions of the embodiments shown in the figures are for exemplary purposes only, and should not be construed limiting the disclosure. One skilled in the art will appreciate that the present disclosure contemplates various embodiments. It should be further appreciated that the features and structures described and illustrated in accordance one embodiment can apply to all embodiments as described herein, unless otherwise indicated. Additionally, it should be understood that the concepts described above with the above-described embodiments may be employed alone or in combination with any of the other embodiments described above.

What is claimed is:

1. An electrical connector comprising:

a dielectric leadframe housing defining a first outer engagement surface;

a plurality of electrical contacts carried by the dielectric leadframe housing;

an external electrical component including a body that defines a second outer engagement surface configured to be attached to the dielectric leadframe housing along a mating direction such that the first and second outer engagement surfaces face each other; and an attachment system including a first engagement member carried by the first outer surface of the dielectric leadframe housing and a second engagement member carried by the body of the external electrical component, the first and second engagement members configured to mate so as to lock the external electrical component to the leadframe housing, thereby resisting separation of the external electrical component from the leadframe housing, wherein the one of the first or second engagement member flexes along a direction that is substantially perpendicular to the mating direction as the external electrical component is attached to the dielectric leadframe housing.

2. The electrical connector as recited in claim 1, wherein the leadframe housing is overmolded onto the electrical contacts.

3. The electrical connector as recited in claim 1, wherein the electrical contacts comprise electrical signal contacts.

4. The electrical connector as recited in claim 3, wherein adjacent electrical signal contacts define differential signal pairs.

5. The electrical connector as recited in claim 4, wherein the external electrical component comprises a ground plate having a ground plate body and at least one plurality of rib that extends into the leadframe housing at a location between adjacent differential signal pairs.

6. The electrical connector as recited in claim 5, wherein a portion of the at least one rib is substantially coplanar with the electrical signal contacts of the adjacent differential signal pairs.

7. The electrical connector as recited in claim 1, wherein the external electrical component comprises a ground plate having a ground plate body that defines the second engagement surface configured to face the first engagement surface when the ground plate is attached to the leadframe housing.

8. The electrical connector as recited in claim 7, wherein the electrical connector includes a plurality of leadframe assemblies, and the ground plate is disposed between adjacent leadframe assemblies.

9. The electrical connector as recited in claim 8, wherein each of the adjacent leadframe assemblies includes respective leadframe housings and electrical signal contacts carried by the leadframe housings, and the ground plate provides an electrical shield between the electrical signal contacts carried by the leadframe housings.

10. The electrical connector as recited in claim 9, wherein the first engagement member comprises a catch and the second engagement member comprises a latch configured to mate with the catch as the leadframe housing and the ground plate are brought together, and the latch flexes along the direction that is substantially perpendicular to the mating direction as the ground plate is attached to the dielectric leadframe housing.

11. The electrical connector as recited in claim 10, wherein the attachment system further includes an alignment assembly configured to limit relative movement between the ground plate and the leadframe housing as the latch mates with the catch.

12. The electrical connector as recited in claim 10, wherein the latch cams over the catch so as to flex as the leadframe housing and the ground plate are brought together along the mating direction.

13. The electrical connector as recited in claim 12, wherein the catch includes a ramp, and the latch rides along the ramp so as to flex as the leadframe housing and the ground plate are brought together along the mating direction until the latch snaps behind the ramp so as to prevent the ground plate from being separated laterally from the dielectric leadframe housing.

14. A leadframe assembly comprising;

a dielectric leadframe housing defining a first outer engagement surface;

a plurality of electrical contacts carried by the dielectric leadframe housing;

an external plate including a body that defines a second outer engagement surface configured to be attached to the dielectric leadframe housing along a mating direction such that the first and second outer engagement surfaces face each other; and an attachment system including:

an attachment assembly including a latch carried by one of the leadframe housing and the external plate, and a catch carried by the other of the leadframe housing and the external plate, wherein the latch and the catch are configured to mate with each other along the mating direction so that at least a portion of the latch overlaps at least a portion of the catch along a first direction that is substantially perpendicular to the mating direction so that the latch and the catch mechanically interfere with each other and lock the external plate to the dielectric leadframe housing with respect to separation of the external plate from the leadframe housing along a direction that is opposite the mating direction; and an alignment assembly that operatively aligns the leadframe housing and the external plate such that the latch and the catch are configured to mate with each other along the mating direction.

15. The electrical connector as recited in claim 14, wherein the plate comprises an electrical shield.

16. The leadframe assembly as recited in claim 14, wherein the latch flexes along the first direction as the latch overlaps at least a portion of the catch.

17. The leadframe assembly as recited in claim 16, wherein the latch flexes along a direction opposite the first direction as the latch and the catch mate along the mating direction.

18. An electrical connector comprising:

a plurality of leadframe assemblies that include a leadframe housing defining a first outer engagement surface, electrical signal contacts carried by the leadframe housing, and a ground plate that provides an electrical shield between the electrical signal contacts carried by adjacent ones of the leadframe housings, wherein the ground plate includes a ground plate body that defines a second outer engagement surface configured to be attached to the dielectric leadframe housing along a mating direction such that the first and second outer engagement surfaces face each other; and an attachment system carried by at least one select one of the plurality of leadframe assemblies, the attachment system including:

a latch carried by the ground plate body, wherein the latch is configured to flex as the leadframe housing and the ground plate are brought together along the mating direction, and wherein the latch is devoid of apertures that extend through the ground plate;

a catch carried by the first outer surface of the dielectric leadframe housing, wherein the catch causes the latch to deflect along a direction substantially perpendicular with respect to the mating direction as the latch and catch mate, and wherein the latch and catch are configured to mate as the leadframe housing and the ground plate are brought together so as to lock the ground plate to the leadframe housing, thereby resisting separation of the ground plate from the leadframe housing; and an alignment assembly configured to limit relative movement between the ground plate and the leadframe housing as the latch mates with the catch.

19. An electrical connector comprising:

a dielectric leadframe housing defining a first outer engagement surface;

a plurality of electrical contacts carried by the dielectric leadframe housing;

a ground plate including a body that defines a second outer engagement surface configured to be attached to the dielectric leadframe housing along a mating direction such that the first and second outer engagement surfaces face each other;

an attachment system including a first engagement member carried by the first outer surface of the dielectric leadframe housing and a second engagement member carried by the body of the ground plate, the first and second engagement members configured to mate so as to lock the ground plate to the leadframe housing, thereby resisting separation of the ground plate from the leadframe housing; and an alignment system including a first datum location member carried by the first outer surface of the dielectric leadframe housing and a second datum location member carried by the body of the ground plate, the first and second datum location members configured to abut each other so as to limit relative movement between the ground plate and the leadframe housing along a direction substantially perpendicular to the mating direction, thereby maintaining alignment between the dielectric leadframe housing and the ground plate as the leadframe housing and the ground plate are being mated, wherein the ground plate is devoid of any apertures that extend through the second datum location member.

20. The electrical connector as recited in claim 19, wherein the one of the first or second engagement member flexes along a direction that is substantially perpendicular to the mating direction as the ground plate is attached to the dielectric leadframe housing.

21. The electrical connector as recited in claim 19, wherein the first and second engagement members are configured to interlock with each other so as to prevent the ground plate from separating from the leadframe housing.

22. The electrical connector as recited in claim 21, wherein the first engagement member comprises a catch and the second engagement member comprises a latch configured to mate with the catch as the leadframe housing and the ground plate are brought together, and the latch flexes along the direction that is substantially perpendicular to the mating direction as the ground plate is attached to the dielectric leadframe housing.

23. The electrical connector as recited in claim 22, wherein the latch cams over the catch so as to flex as the leadframe housing and the ground plate are brought together along the mating direction.

24. The electrical connector as recited in claim 23, wherein the catch includes a ramp, and the latch rides along the ramp so as to flex as the leadframe housing and the ground plate are brought together along the mating direction until the latch snaps behind the ramp so as to prevent the ground plate from being separated laterally from the dielectric leadframe housing.

* * * * *